US009427763B2

(12) United States Patent
Fuller et al.

(10) Patent No.: US 9,427,763 B2
(45) Date of Patent: Aug. 30, 2016

(54) LUMINOUS WATER WALL DISPLAY

(71) Applicant: WET, Sun Valley, CA (US)

(72) Inventors: Mark Fuller, Sun Valley, CA (US); James Doyle, Sun Valley, CA (US); Howard Tsi, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 14/167,982

(22) Filed: Jan. 29, 2014

(65) Prior Publication Data

US 2014/0240958 A1 Aug. 28, 2014

Related U.S. Application Data

(60) Provisional application No. 61/758,563, filed on Jan. 30, 2013.

(51) Int. Cl.

| | |
|---|---|
| ***G09F 13/24*** | (2006.01) |
| ***B05B 17/08*** | (2006.01) |
| ***G09F 19/02*** | (2006.01) |
| ***G09F 13/22*** | (2006.01) |
| ***G09F 19/22*** | (2006.01) |
| *F21W 121/02* | (2006.01) |

(52) U.S. Cl.

CPC ..... *B05B 17/085* (2013.01); *G09F 13/22* (2013.01); *G09F 13/24* (2013.01); *G09F 19/02* (2013.01); *G09F 19/22* (2013.01); *F21W 2121/02* (2013.01)

(58) Field of Classification Search

CPC ..... F21W 2121/02; B05B 17/085
USPC ..... 40/406
See application file for complete search history.

(56) References Cited

U.S. PATENT DOCUMENTS

| | | | | |
|---|---|---|---|---|
| 3,174,688 | A * | 3/1965 | Chatten | 239/20 |
| 3,568,927 | A * | 3/1971 | Scurlock | 239/17 |
| 3,937,388 | A * | 2/1976 | Zimmerman | 228/222 |
| 4,747,538 | A * | 5/1988 | Dunn et al. | 239/20 |
| 4,806,392 | A * | 2/1989 | Dixon | 428/18 |
| 5,167,368 | A * | 12/1992 | Nash | 239/17 |
| 5,738,280 | A * | 4/1998 | Ruthenberg | 239/17 |
| 6,268,801 | B1 * | 7/2001 | Wu | 340/815.45 |
| 6,279,835 | B1 * | 8/2001 | Hansen | 239/20 |
| 6,311,898 | B1 * | 11/2001 | Gruff | 239/17 |
| 6,539,654 | B2 * | 4/2003 | Lin | 40/406 |
| 7,922,103 | B2 * | 4/2011 | Houstoun | 239/20 |
| 8,225,539 | B2 * | 7/2012 | Beebe | 40/406 |
| 8,292,195 | B2 * | 10/2012 | Freeman | 239/20 |
| 2004/0088894 | A1 * | 5/2004 | Haughton et al. | 40/406 |
| 2005/0099363 | A1 | 5/2005 | Yamamoto et al. | |
| 2005/0258268 | A1 * | 11/2005 | Watson et al. | 239/17 |

(Continued)

FOREIGN PATENT DOCUMENTS

KR 2002 0086398 A 11/2002

OTHER PUBLICATIONS

Patent Cooperation Treaty, International Search Report and Written Opinion, PCT/US2014/013692, May 14, 2014, 9 pages.

*Primary Examiner* — Gary Hoge
(74) *Attorney, Agent, or Firm* — Maceiko IP

(57) ABSTRACT

A water display is described having a lighting array emanating light that travels through a wall. Water flows down the wall to vary the appearance of the light that shines through the wall. The flow of water and particular lights being turned on and off may be controlled. Dramatic visual effects are provided including the appearance of moving art.

20 Claims, 26 Drawing Sheets

(56) References Cited

U.S. PATENT DOCUMENTS

2006/0023469 A1* 2/2006 Chernoff et al. ..... 362/565
2006/0208369 A1* 9/2006 Hayden ..... 261/36.1
2010/0187325 A1* 7/2010 Houstoun ..... 239/17
2010/0195309 A1* 8/2010 Cieslak ..... 362/96
2010/0327076 A1 12/2010 Freeman
2011/0252677 A1 10/2011 Beebe

* cited by examiner

LUMINOUS WATER WALL DISPLAY

CROSS REFERENCE TO RELATED APPLICATION

The application claims the benefit of U.S. Provisional Application No. 61/758,563, filed Jan. 30, 2013, the contents of which are incorporated herein by reference as if fully set forth herein.

FIELD OF THE INVENTION

The present invention relates generally to displays that may include water and/or lighting components, including displays where the appearance of lighting may be focused or otherwise altered by water. To this end, the present invention may provide visual effects such as moving art in the form moving and/or transforming abstract shapes.

BACKGROUND OF THE INVENTION

Various water and/or lighting displays exist. However, the manner in which the water and lighting interact with each other in such displays may be limited. For example, the use of water to focus or otherwise alter light passing through the water has not been used. Accordingly, there is a need for innovative techniques in which light may be passed through water to provide visual effects.

There have also been large water and lighting displays such as fountains, laser light shows and the like. However, there has not been a water and light display that may cover a wall in a building, especially where that display may extend several floors, for example, in an atrium or hotel lobby. Accordingly, there is a need for a display that may be installed in such a location as well as other locations.

SUMMARY OF THE INVENTION

In a first aspect of the invention, a display is described including water and lighting components. The lighting component may comprise an array of lights, such as LEDs, that may turn on and off randomly or in a programmed fashion. The lighting array may be formed as a grid and hung or mounted to a wall or other substrate. The water component may include a wall that may be transparent or translucent, or may be comprised of a mesh material such that light may pass through the gaps in the mesh. The water wall may be positioned in front of the lighting array. A film of water may travel down the wall, and as this occurs, lights in the light array may be turned on and off. The water may alter the appearance of the lighting as it travels through the water wall thereby providing dramatic visual effects.

In another aspect of the invention, the flow of water may be varied. This may change the degree that the light is focused by the water. For example, the appearance of the light and/or the edges thereof may be softened as the flow of water increases and may appear sharper as the flow decreases. In general, this aspect of the current invention involves how the refraction and appearance of light may vary as it travels through different volumetric flows of water. The water flow may be varied under computer control.

In another aspect of the invention, particular lights in the light array may be turned off and on so as to provide variable lighting effects. For example, adjacent lights may be sequentially turned on as previously lit lights are turned off, thereby providing the appearance of a shape or abstract form moving and/or changing shape. The sequencing and manner in which lights are turned on and off may occur under computer control.

In another aspect of the invention, music may accompany the water and/or lighting effects. For example, certain music may be played to compliment the visual effects being provided at a particular time. This may occur under computer control.

In another aspect of the invention, the display may be built into, as part of, or to otherwise cover a wall of a building or other stationary object. Alternatively, the display of the current invention may be portable for use at concerts, museums or other events.

In another aspect of the invention, marketing messages may be displayed. For example, where the display is built to cover a wall of a hotel lobby, the display may periodically display the hotel's logo.

In another aspect of the invention, a water delivery and recovery system is described. This may include various piping and controls to vary the flow of water over the water wall. This may also include a filtration system.

Other aspects of the invention are described below.

DETAILED DESCRIPTION OF THE PREFERRED EMBODIMENTS

Figure 1:
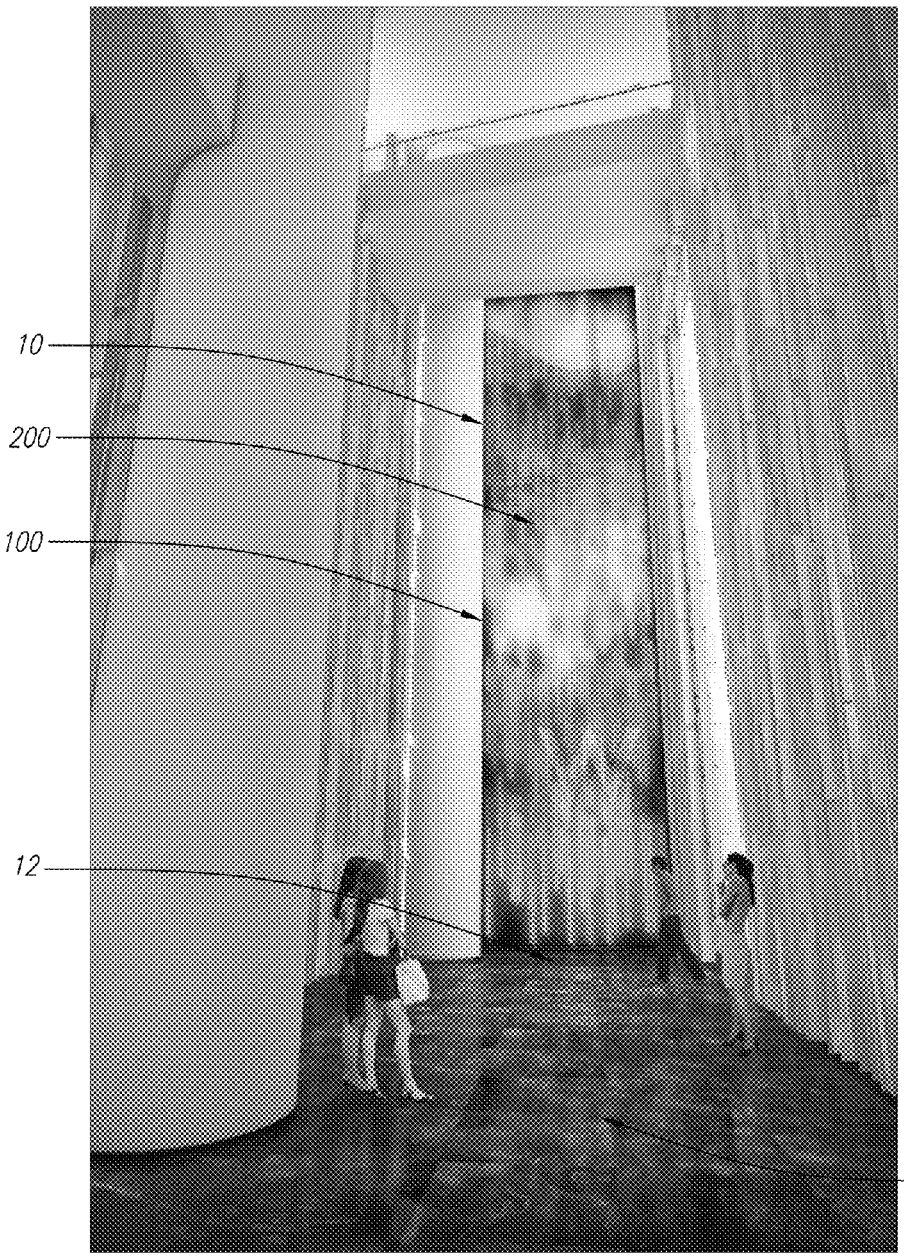
FIG. 1 is a perspective view of a display.

The display 10 of the current invention and the visual effects that it may produce are now described with reference to the figures. Where the same or similar components appear in more than one figure, they are identified by the same reference numeral. The invention is described herein with reference to water. However, other liquids and combinations thereof are within the scope of the invention. Furthermore, the invention is described herein with reference to LED lighting though other types of light sources may be used. In general, display 10 provides dramatic visual effects by altering the appearance of light as it travels through water. For example, display 10 may provide moving art as discussed herein.

Figure 1B:
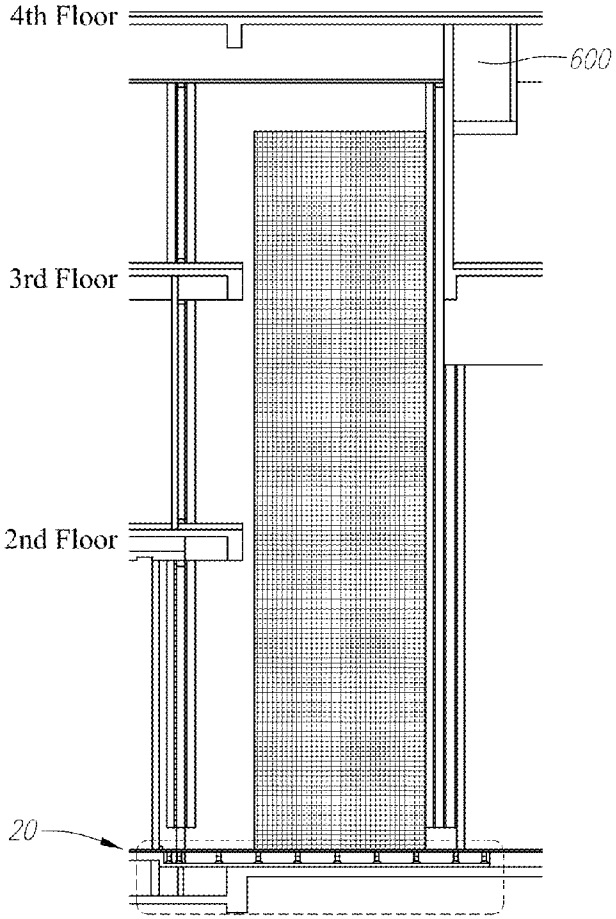
FIG. 1B is another front sectional view of the display of FIG. 1A taken at another section a distance from the display.
Figure 1A:
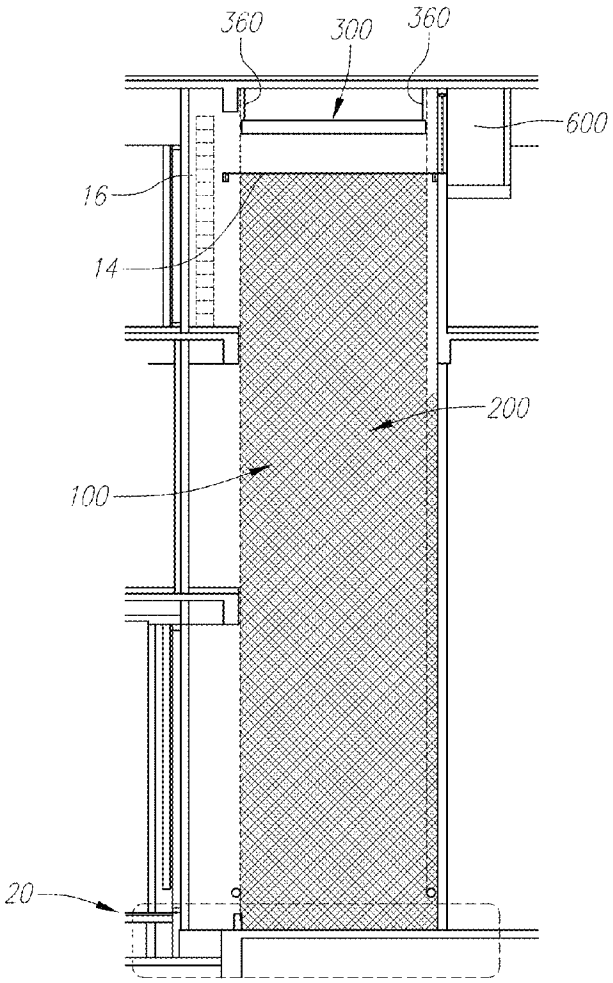
FIG. 1A is a front sectional view showing an embodiment of a display that may extend vertically for several floors of a building.

FIG. 1 shows an embodiment of display 10 installed adjacent to a wall of a building lobby. Display 10 may be installed in hotels, public buildings or other locations. As shown, display 10 may be relatively large and extend upward for several floors of the building. In this manner, display 10 may be suitable for atriums. FIGS. 1A and 1B also show the manner in which display 10 may extend up several floors of a building. In this embodiment, a pool 12 may reside in the lobby floor in proximity to display 10. Pool 12 may provide water for display 10. In general, display 10 may include water wall assembly 100, and lighting array assembly 200 positioned behind water wall assembly 100.

As discussed in more detail below, water may flow down water wall assembly 100, while the lights of lighting array 200 may be turned on and off to provide dramatic visual effects. These visual effects are enhanced and manipulated by optical effects that occur as the light travels through the water. To this end, the appearance of the lighting may be altered or adjusted by increasing or decreasing the water flow down water wall assembly 100. Changing the volume of water flow may generally alter the refraction and/or appearance of the light as it travels through the water.

In the embodiment of FIG. 1, lighting array assembly 200 is shown in proximity to an interior of wall of a building, such as in a hotel lobby. Alternatively, however, lighting assembly 200, and display 10, may be located on the exterior of a building. Lighting array 200 may include an array of LED or other types of lights. Water wall assembly 100 may be positioned in front of lighting array assembly 200. With this embodiment, given the size and placement of display 10, the building lobby is provided with a unique and dramatic visual display that may serve as an attraction for the building itself. This may be advantageous to market the opening of the building. To this end, where the building is a hotel or other brand establishment, display 10 may enhance the brand.

The display 10 of the current invention is not limited to large installations in buildings. For example, display 10 may be configured to be smaller and/or portable. To this end, a portable embodiment of the current invention may be temporarily set up for concerts, parks, museums or other events or locations.

Figure 2:
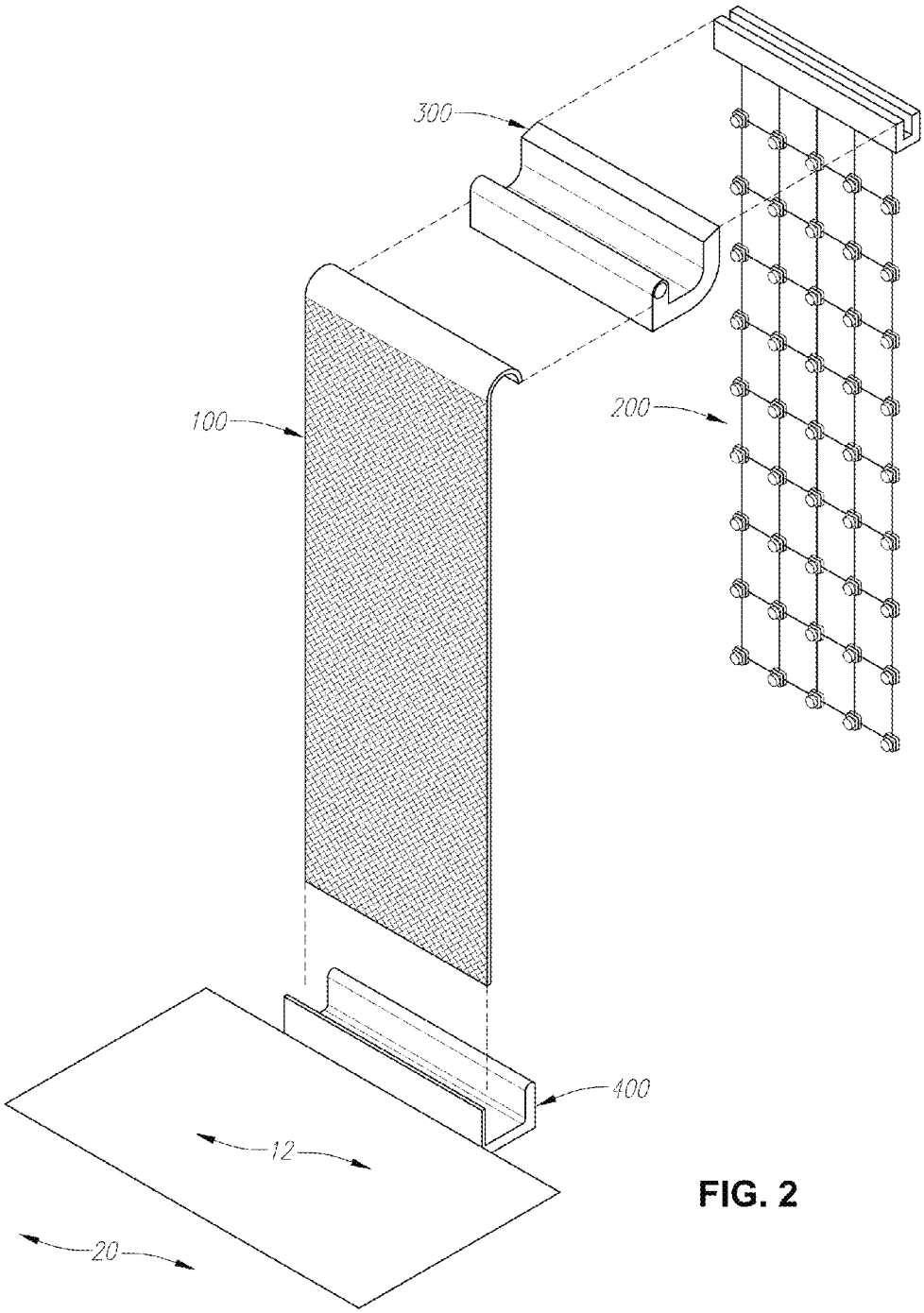
FIG. 2 is an exploded view showing a water wall assembly, lighting array assembly, upper water trough assembly and lower water trough assembly.
Figure 7:
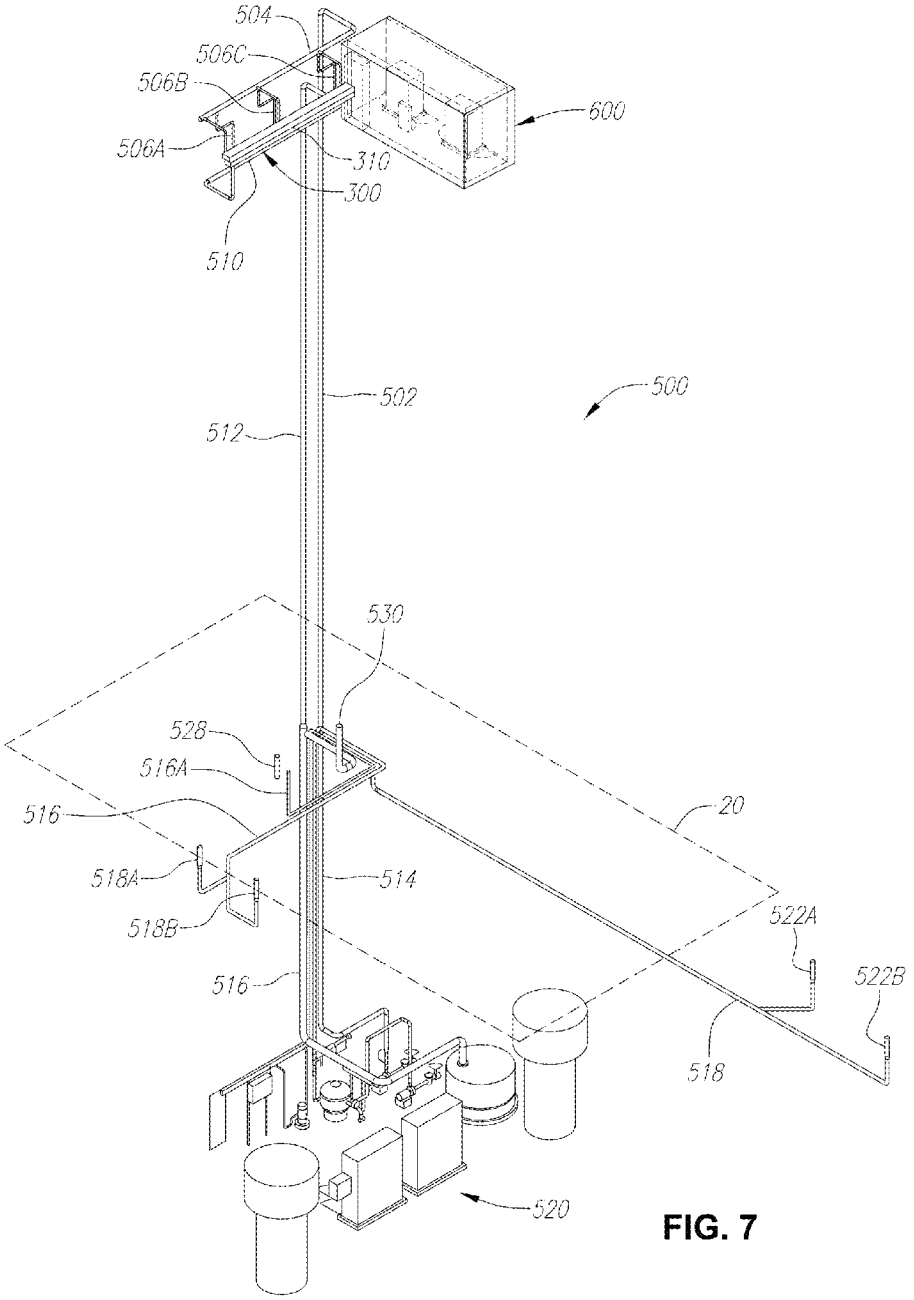
FIG. 7 is a perspective view of a water delivery and return system, or piping system.

Display 10 is now further described with reference to the exploded view of FIG. 2. As shown, display 10 may comprise water wall assembly 100, lighting array assembly 200, upper water trough assembly 300 and lower water trough assembly 400. In general, water is delivered from upper trough assembly 300 to water wall assembly 100. The water then flows down water wall assembly 100 and may be received by lower trough assembly 400. A water delivery and recovery system or piping system 500 (as shown in FIG. 7) may also be included to treat the water received by lower trough assembly 400 and to pump water back up to upper trough assembly 300 as discussed later. As also shown, pool 12 may be located in proximity of display 10. Pool 12 may serve as a source of water for display 10, though other water sources may be used.

As such, water flows down wall assembly 100 in front of lighting array assembly 200. The flow of water down wall assembly 110 may be varied to focus, soften or otherwise alter or enhance the appearance of the light shining through wall assembly 100 that may be seen by observers.

Water wall assembly 100 is now further described with reference to FIGS. 1A, 1B, 1C, 2 and 4. In general, water wall assembly 100 may include a wall or screen 110 having an upper end 112 and lower end 114. Upper end 112 may engage upper water trough assembly 300 and lower end 114 may engage lower water trough assembly 400. More particularly, upper end 112 may wrap up and around a bull nose feature 316 of water trough 300 and then attach to upper water trough 310 as discussed below. When installed, the assemblies shown in FIG. 2 are arranged so that they interact with each other as shown in the other figures discussed below.

Wall 110 may be configured in a number of different ways and may comprise various materials. For example, wall 110 may comprise a continuous, transparent or translucent material which allows light to pass through. Alternatively, wall 110 may comprise a mesh or screen material such that light may pass through the gaps or spaces in the mesh or screen. For example, wall 100 may comprise glass, acrylic, metals, synthetic screens or meshes or other suitable materials, or combinations thereof. Accordingly, it should be noted that wall 110 of the current invention is not limited to a solid wall in the conventional sense. Instead, wall 110 may comprise any configuration on which water may travel downward and through which light may travel.

Figure 1C:
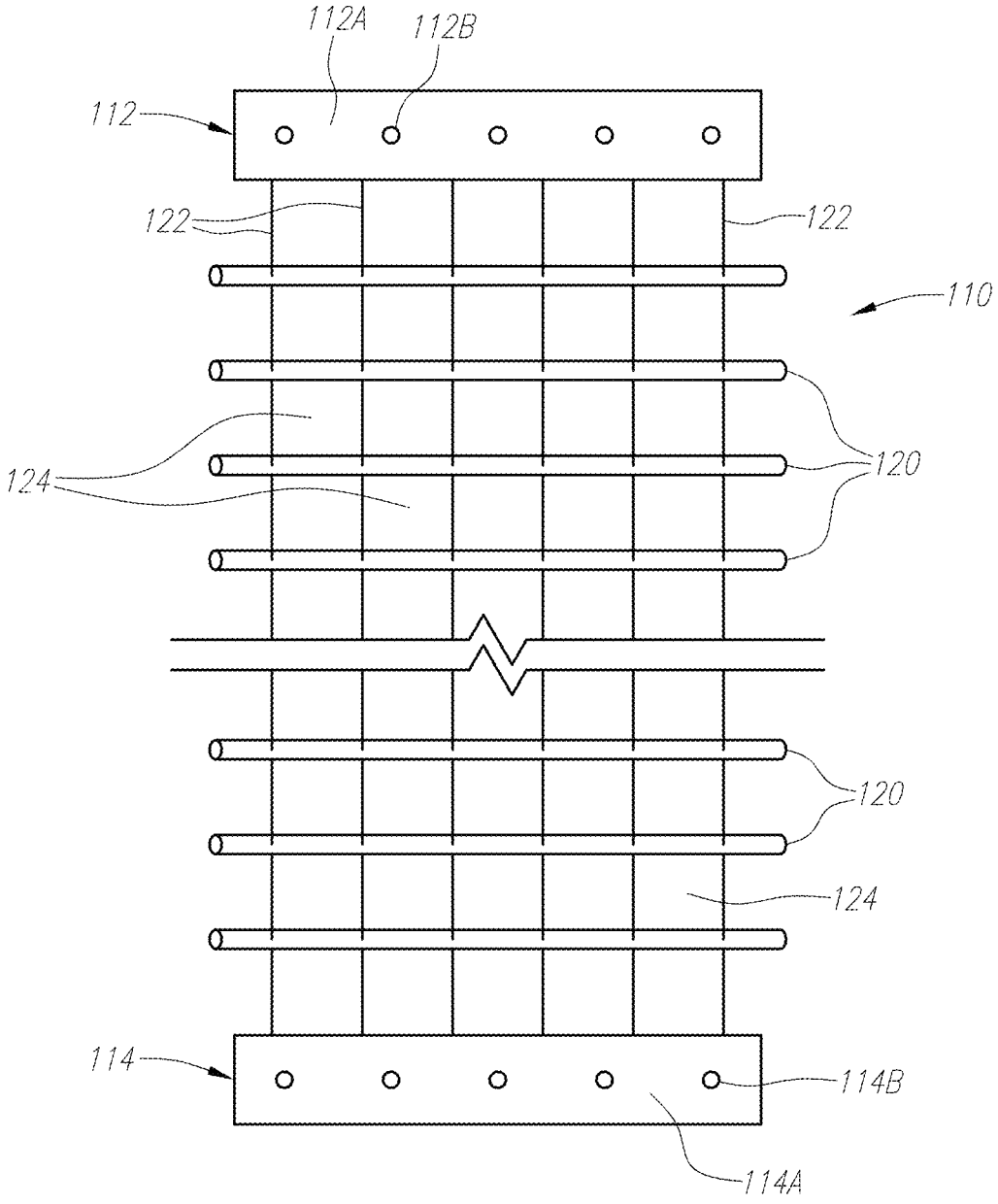
FIG. 1C is a front view of the mesh or screen for a water wall.

In a preferred embodiment, as shown in FIG. 1C, water wall 110 may comprise a screen or mesh made up of generally horizontal rods 120 and generally vertical cables 122 holding the rods 120 together. It is preferred that rods 120 and cables 122 comprise a material that will resist corrosion upon contact with water or other liquid. For example, rods 120 and cables 122 may comprise stainless steel, though other materials may be used.

In the embodiment involving rods 120 and cables 122, wall 110 may form a matrix which may include horizontally oriented rectangular gaps or spaces 124 within the matrix. In this configuration, horizontal rods 120 may form the tops and bottoms of the empty rectangular gaps or spaces 124 within the matrix, and the vertical cables 122 may form the sides of spaces 124. Accordingly, the intersections of the horizontal rods 120 and vertical cables 122 may define the corners of the empty rectangular gaps or spaces 124 within the matrix. It should be noted that wall 100 of the current invention is not limited to the horizontal rectangles, and other shapes such as squares may be used.

As shown in FIG. 1C, the vertical distance between horizontal rods 120 may generally be uniform, as may be the horizontal distance between vertical cables 122. In this manner, rectangular gaps or spaces 124 may be generally consistent in shape across the surface of wall 110. As an alternative, however, horizontal rods 120 and/or vertical cables 122 may be spaced at varying distances to provide gaps or spaces 124 that are not uniform.

In addition, while this embodiment describes rods 120 as being horizontal, and cables 122 as being vertical, rods 120 and cables 122 may instead be positioned vertically and horizontally, respectively. As another alternative, rods 120 and cables 122 may be positioned diagonally. This diagonal orientation may result in the empty gaps or spaces 124 being diamond-shaped, triangular shaped or formed in other shapes. Also, rods 120 and cables 122 may be configured such that the empty gaps or spaces 124 result in circular shapes, oval shapes or other shapes that have smooth contours.

Rods 120 and cables 122 may be connected to each other in a variety of ways. For instance, rods 120 may include vertical holes that are spaced to allow vertical cables 122 to pass through rods 120. The diameter of the holes may be chosen such that cables 122 may be held tightly within the holes by a friction fit. However, rods 120 and cables 122 may be secured together using various attachment means such as welds, nuts and bolts, set screws, clamps or other suitable means. In addition, horizontal rods 120 may include slots or notches that receive vertical cables 122. Horizontal rods 120 and vertical cables 122 may also be woven together with the intersections of rods 120 and cables 122 being held together using similar means as described above.

While the above description of wall 110 describes horizontal rods 120, these components may comprise other types of structures such as cables, slats or other devices. And while the above descriptions of the vertical cables 122 depicted them as cables, these structures may also be other types of structures such as rods, slats or other devices. In general, various types of components may be used that may function together as a mesh or screen.

An advantage of using a mesh comprising rods 120 and cables 122 is that water wall 110 may be rolled up when being transported to the installation site, and then unrolled when hung up. To this end, the materials comprising cables 122 may be flexible to provide this capability. This may significantly ease the overall installation of display 10, when compared to a wall 110 comprising, e.g., a rigid piece of glass, especially for larger installations such as the one shown in FIG. 1 spanning several floors. Another advantage of a mesh water wall 110 for larger installations is that it may provide some flexibility after it is installed, which may be significant where the building may sway or where there may be humidity or other atmospheric condition that may cause wall 110 to expand or contract. In any event, it is preferred that water wall 110 be tensioned when connected to upper and lower trough assemblies 300, 400 as discussed below.

As noted above, water wall 110 may comprise other materials such a solid, continuous, transparent or translucent material such as glass, acrylic or other transparent or translucent material. Though glass and similar materials may still be used for large installations as shown in FIG. 1, these materials may be especially suited for smaller embodiments of display 10 because they may be easier to handle.

Wall 110 may include an exterior surface 116 that faces observers as well as an interior surface 118 that faces lighting array assembly 200. Either or both of surfaces 116, 118 of wall 110 may have a textured surface. That is, whether the wall 110 is comprised of a mesh or screen, or a solid transparent or translucent material, the surface(s) of wall 110 may have textures such as bumps, scrapes, grooves, slots, notches or other types of texture applied to it. Indeed, the surfaces of rods 120 and cables 112 may themselves provide texture. In addition, the texture may also be contained within the solid material of the wall if wall 110 is comprised of solid transparent or translucent materials. Solid materials may also be laser etched to create texture. Texture on the surface and/or within water wall 110 may enhance the visual effects provided as light travels through wall 110 by varying the manner in which the light is refracted as it travels through wall 110.

Upper water trough assembly 300 is now further described with reference to FIGS. 2, 3, 4 and 11. Upper water trough assembly 300 may include trough 310 which may receive water from the water piping system 500 and may in turn provide water to water wall 110 so that water may flow down. As shown in FIG. 2, the length of trough 310 may generally correspond to the width of water wall 110 so that water may be delivered across the entire width of wall 110. However, other lengths for trough 310 may be used.

Figure 3:
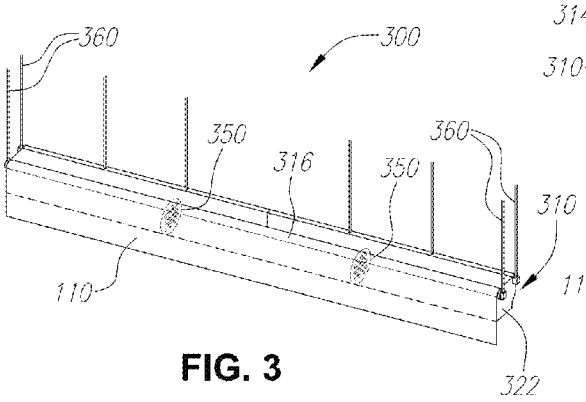
FIG. 3 is a perspective view of an upper water trough.
Figure 4:
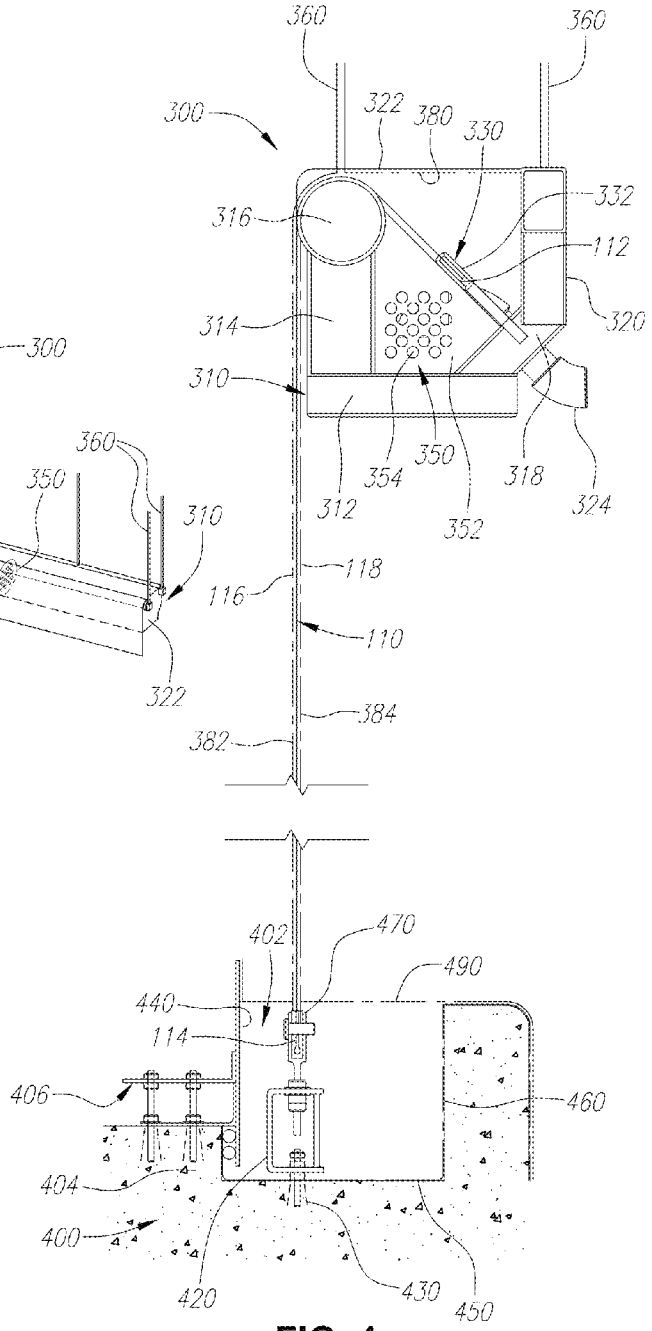
FIG. 4 is a side view showing the interaction between a water wall, upper trough and lower trough.

Trough 310 may include bottom 312, front wall 314, bullnose 316, diagonal wall 318, rear wall 320 and end caps 322. When these components are assembled as shown in FIGS. 3 and 4, trough 310 may be formed. It is preferred that these components fit tightly together to avoid any leaks. To this end, gaskets may be provided between these components. It is preferred that the height of bullnose 316 is lower than the heights of back wall 320 and end caps 322. This allows water to flow over bullnose 316 without also flowing over the other top edges of trough 310. It should be noted that other types of components having different shapes may be used to form trough 310.

In the embodiment of display 10 shown in FIG. 1, trough 310 may be hung from a ceiling (as shown in FIG. 1A) or from some other support structure in the building. To this end, trough 310 may be suspended by cables or rods 360 as shown in FIGS. 3 and 4. Alternatively, trough 310 may be configured within other frames or structures that provide adequate support. For example, display 10 may include a frame structure to which one or more of the water wall assembly 100, lighting array assembly 200 and upper water trough assembly 300 may be attached. This type of configuration may be preferable where display 10 is intended to be self-contained and/or portable for use at temporary events and locations as mentioned above.

In the embodiment of FIG. 1 where display 10 is relatively large, trough 310 may be about 15 feet long, and may be about 2 feet deep and about 2 feet tall, though other lengths may be used depending on the installation and the current invention is not limited to this approximate size. However, this example is provided because for larger installations, trough 310 may have significant weight. Accordingly, it is preferred that bottom 312, front wall 314, bullnose 316, diagonal wall 318 and/or rear wall 320 comprise generally hollow structures to lower their overall weight. However, the components comprising trough 310 are preferably strong enough to support the weight of the water or other liquid contained therein.

Figure 6:
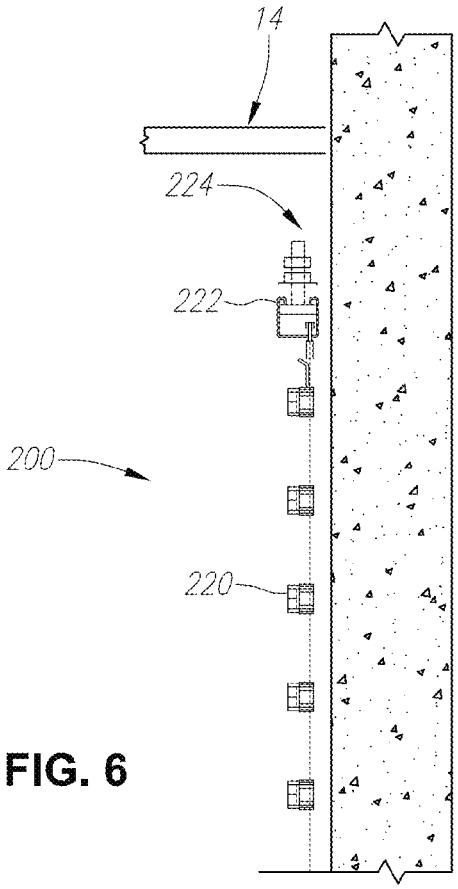
FIG. 6 is a side view of a lighting array.

Reducing weight preferably eases installation, especially where trough 310 is mounted to a ceiling, to a wall or to some other position located a distance above the ground. To assist in installation and/or later maintenance of display 10, a catwalk 14 may be installed into or otherwise reside in the building as shown in FIGS. 1A and 6. Catwalk 14 may provide access for individuals to hang trough 310, hang lighting array 200, install the piping of system 500 and to perform later maintenance. Ladder 16 may also be provided to access catwalk 14 as shown in FIG. 1A.

As shown in FIG. 1, it is preferred that catwalk 14 not be visible to observers on the ground to avoid detracting from the artistic effects provided by display 10. To this end, trough 310 may also be hidden from view of the observers so that only water wall 110 and its visual effects may be seen.

FIGS. 1A and 1B exemplify how certain components are visible to the observer while other components may remain hidden. FIGS. 1A and 1B are front sectional elevation views of display 10 taken at different section lines. The section view of FIG. 1A is taken at a point within display 10 and shows certain of the components that remain behind the scenes and are not visible to the observer. For example, FIG. 1A shows how trough assembly 300 may be hung from the ceiling by cables or rods 360. FIG. 1B shows display 10 from a point where the observer may view the display. From here, trough assembly 300, catwalk 14 and other items are preferably not visible so that only the visual effects may be seen. The section view of FIG. 1B is taken at a point at a distance from display 10, e.g., at a point where an observer may view the display. This figure shows how certain components may remain hidden.

Figure 11:
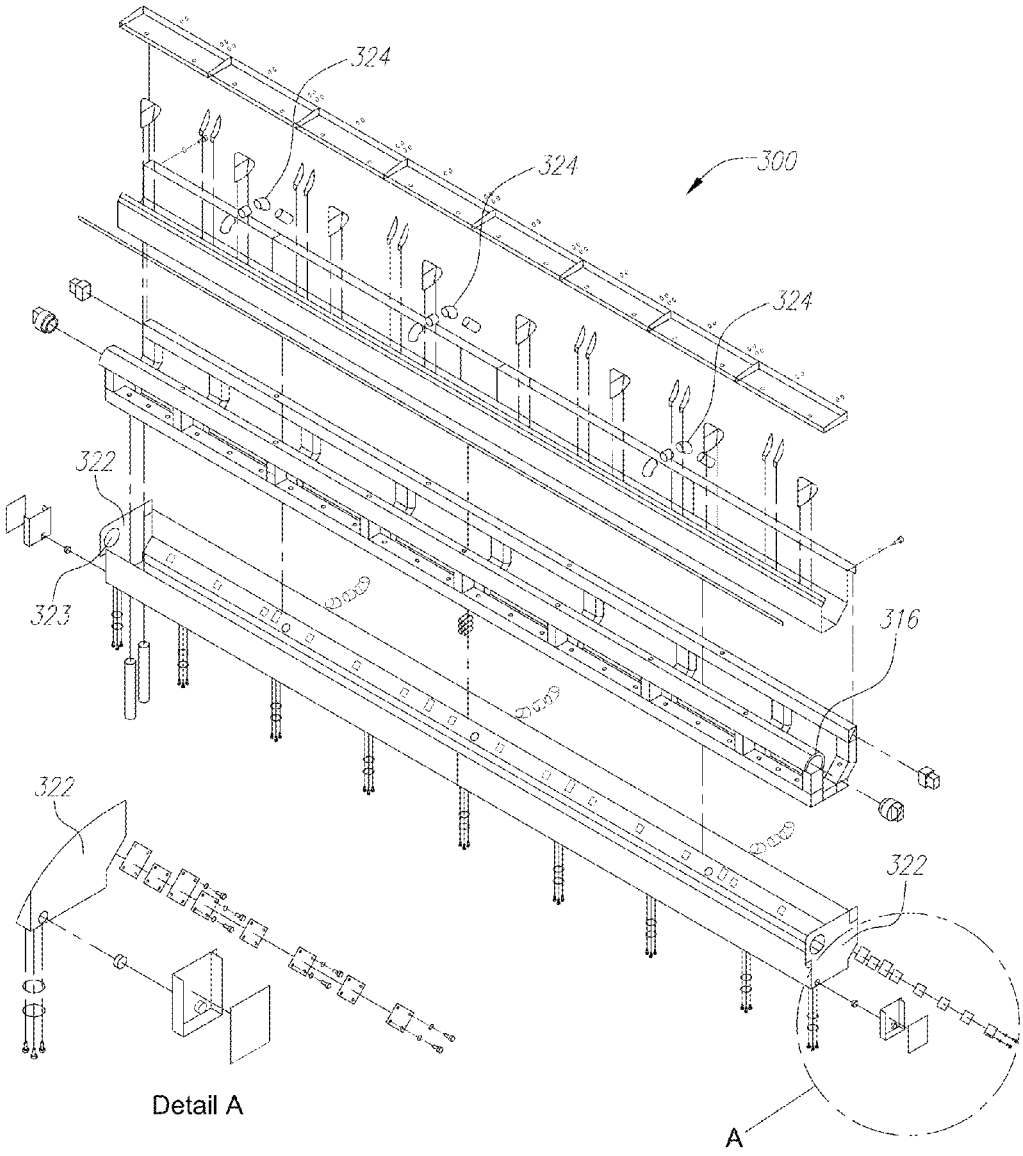
FIG. 11 is an exploded view of an upper water trough assembly.
Figure 12:
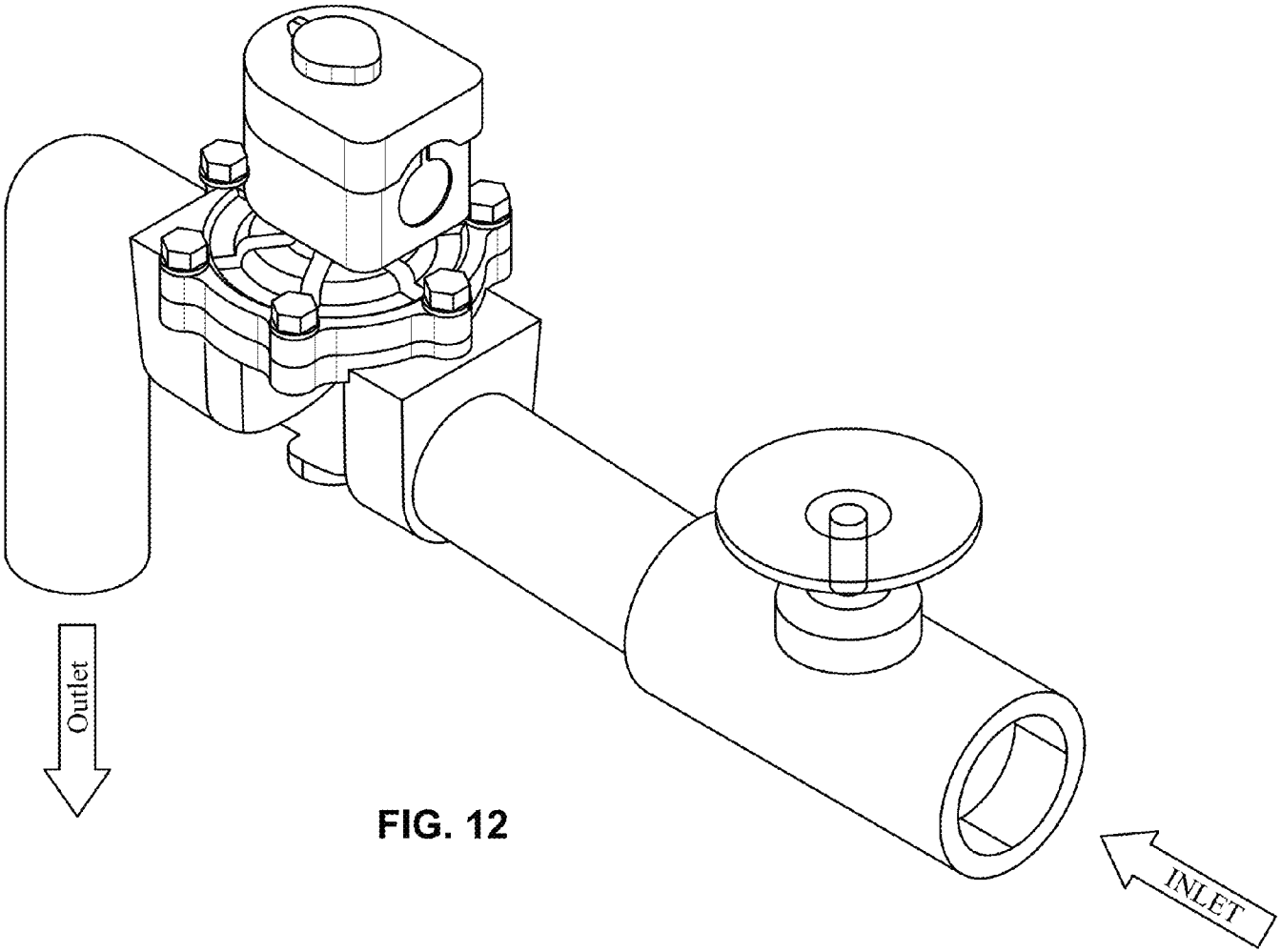
FIG. 12 is a perspective view of an animation valve.

Water may be fed into trough 310 through one or more inlets 324, which may in turn be fed by piping system 500 as discussed in more detail later. As shown in FIGS. 4 and 11, inlets 324 may be connected to diagonal wall 318, but water may be fed into trough 310 from other locations and by other means. As noted above, it is preferred that water leave trough 310 only over bullnose 316 so that water only falls down water wall 110 as opposed to the sides of display 10. To avoid or reduce any longitudinal wave action in trough 310 that may be created by the inflow of water, one or more baffles 350 may be positioned in trough 310.

As shown in FIG. 3, two baffles 350 may be located thereby separating trough 310 into three compartments, i.e., one for each inlet 324. In this manner, if one of the inlets 324 delivers more water than one or more of the other inlets 324, any longitudinal wave action that may be created thereby is preferably damped or eliminated by baffles 350. Baffles may also reduce or eliminate longitudinal wave action that may arise where trough 310 sways as it is suspended from a ceiling or other structure. As shown, baffles 350 may comprise a wall 352 with some number of holes 354 therein. The number of baffles 350 used in trough 310 may vary according to the trough's dimensions or other factors. Baffles 350 may comprise a corrosion-resistant material.

Baffles 350 may thus generally stabilize the water contained in trough 310. This preferably helps a smooth uniform flow of water from trough 310 over bullnose 316 and down water wall 110. As discussed below, the flow of water down wall 110 may increase or decrease significantly in a short amount of time. To do so, inlets 324 may provide a surge of water, and any wave action created thereby is preferably limited by baffles 350.

Bullnose 316 is now described in more detail. As shown in FIGS. 3, 4 and 11, bullnose 316 may be secured to trough 310 by fitting into holes 323 in end plates 324. However, other attachments means may be used. Bullnose 316 may be used to help secure the upper end 112 of water wall 110 to upper trough assembly 300 in a manner that allows the smooth delivery of water from trough 310 down wall 110.

As shown in FIG. 4, the cross section of bullnose 316 may be generally circular. This circular shape provides for a smooth delivery of water from trough 310 to wall 110 so that the water may be delivered to wall 110 in a laminar fashion. That is, the avoidance of sharp edges or other perturbations as the water is delivered to wall 110 helps provide laminar flow. This may in turn provide more control over how the appearance of the light may be altered.

While the cross section of bullnose 316 in this embodiment is circular, other cross sectional shapes may be used so that the water is delivered in other manners. For example, other shapes such as square, rectangular, triangular or other sharper-edged shapes may be used so that the water is provided in a turbulent manner. The cross section of bullnose 316 may also be a hybrid of various shapes.

The manner in which water wall 110 may be attached to upper trough assembly 300 is now further described with reference to FIGS. 2 and 4. As shown, after wall 110 is wrapped around bullnose 316, the upper end 112 of water wall 110 may extend into trough 110 and be secured to clevis 330. Clevis 330 may in turn be attached to diagonal wall 318.

When water wall 110 is secured to trough 310 in this manner, it should be noted that the circular cross section of bullnose 316 dissipates the stresses placed on the upper region of wall 110 that may arise in the area of contact between wall 110 and bullnose 316. This avoids the situation where a concentrated stress point would exist if wall 110 were wrapped around a component having a square cross section or other sharp edge. Accordingly, the circular cross section of bullnose 316 provides a stress dispersion function as well as a laminar water delivery function.

The manner in which clevis 330 may engage the upper end 112 of wall 110 is now further discussed with reference to FIGS. 1C and 4. As shown in FIG. 1C, the top and bottom edges 112, 114 of wall 110 may generally include a solid material such as upper tang 112A and lower tang 114A. Top tang 112A may include a series of holes 1128, while lower tang 114A may include a series of holes 1148.

Clevis 330 may include a clevis bolt (not shown) that may pass through an upper tang hole 112A as is customary in clevis arrangements. Trough 310 may include a clevis 330 for each hole 112B. In this manner, the stress created by holding up the weight of wall 110 may be spread over upper end 112 by an appropriate number of clevises 330. The number of clevises 330 that wall 110 engages may vary according to the width and weight of wall 110 and/or trough 310, or other factors.

Each clevis 330 may preferably be threaded onto a bolt that engages diagonal wall 318. In this manner, the tension of each clevis 330 and on the wall 110 at that location may be adjusted by an adjustment means 332, i.e., the position of clevis along the threads of the bolt may be adjusted. This is preferred especially in larger installations where the tension across the width of wall 110 may be desired to be uniform or may need to vary so that wall 110 does not warp along its length which may extend several floors of a building. Accordingly, the use of multiple clevis couplings 330 allows the stress on each to vary as needed, i.e., different sections of the upper end 112 of the water wall assembly 100 may absorb different levels of tension to properly hold the water wall 110 flat or as otherwise desired.

For reasons that will become more apparent in later sections, it may be preferred that water wall 110 be held in place flat across its surface area in order to optimize the lighting effects provided by display 10. The ability to adjust each clevis 330 independently may allow for this flatness. As shown in FIG. 1A, catwalk 14 or other structures may be positioned near the upper trough assembly 300 to provide access to install clevises 330 and to allow them to be adjusted as needed.

Lower water trough assembly 400 is now further described with reference to FIGS. 2 and 4. As shown, lower water trough assembly 400 is generally positioned near the bottom of the display 10 to collect the water that flows down water wall 110. Lower trough assembly 400 may also serve to provide any other water that may need to be collected near or at the bottom of the display 10.

Lower water trough assembly 400 may generally comprise lower trough 402 which may serve to catch water after it has traveled down the length of water wall 110. As shown in FIG. 4, trough 402 may be formed into the floor of a building. As shown in FIG. 1, trough 402 may be kept from view of the observers. To this end, trough 402 may be formed in a sub floor 404 located underneath the floor 20 (as in FIG. 1) on which the observers may stand. Water wall 110 may also extend below the floor and into trough 402. In this manner, only water wall 110 may be readily visible to the observer. Similar to hiding the upper trough assembly 300 out of view, hiding the lower trough assembly 400 may enhance the visual effects in that the entire visible wall comprises display 10.

As noted above, trough 402 may be designed into the floor, or sub floor 404 where trough 402 exists below the area which is visible to observers. To this end, sub floor 404 may provide a trough bottom 450 and back wall 460 by virtue of forms that may be used when pouring the concrete comprising the sub floor 404. Trough 402 may also include a front wall 440 that may be separate from the sub floor 404 but attached thereto by mounting devices 406 which may in turn include brackets, angle irons and mounts and bolts as shown. In this manner, the height of front wall 440 may be adjusted. Front wall 440 may be formed of stainless steel or other corrosion-resistant material.

As an alternative to forming lower trough 402 as part of sub floor 404, lower trough 402 may comprise of a separate structure that is separate from the floor below the display 10, or it may comprise a combination of the floor below the bottom of the display 10 and a separate structure. In these alternatives, front wall 440, bottom 450 and back wall 460 may comprise steel, plastic, concrete or other suitable corrosion-resistant materials. These components preferably fit together without gaps such that the overall lower water trough assembly 400 is water tight. Also, lower water trough assembly 400 may have a lid (not shown) if desired.

In addition, there may be a pool 12 (as in FIG. 1) of water that is positioned in front, in back or generally around the bottom area of the display 10. Water for this pool 12 may be provided by the lower water trough assembly 400 through pipes, channels or other means, such as described later in connection with piping system 500. Alternatively, water from pool 12 may act as a water supply for lower trough 402.

The manner in which water wall 110 engages lower trough assembly 400 is now further described with reference to FIGS. 1C and 4. As noted above, the lower end 114 of water wall 110 may include tang 114A which in turn include a number of holes 114B. Each hole 114B may engage clevis 470 that is in turn connected to clamp or bracket 420 that in turn engages anchor bolt 430 that in turn engages trough floor 450. As with clevises 330 in upper trough 310, a number of clevises 470 may be used to engage water wall 110 at a number of locations along its bottom. Also, clevises 470 are preferably adjustable in order to adjust the tension applied to the lower end 114 of wall 110.

The combination of clevis 470 and clamp 420 may be preloaded with adequate tension to hold the lower end 114 of water wall 110 secure such that the surface of water wall 110 remains generally flat, and may also flex enough to allow for some expansion and/or contraction of water wall 110 during construction or at other instances. This flexing may also be preferable to allow the water wall assembly 100 to expand and/or contract depending on the amount of water that may be present on the surfaces of water wall 110 which may vary the weight of water wall 110 accordingly.

In general, clevises 330 in upper trough 310 and clevises 470 in lower trough 402 may be adjusted so that the desired overall tension and flatness of water wall 110 may be achieved. In one method of installation, the upper end 112 of wall 110 may be attached to clevises 330 in upper trough 310, and then upper trough 310 may be hoisted to its desired location. Once upper trough 310 is secured to the ceiling, wall or other desired location, the bottom end 114 of wall 110 may be attached to clevises 470, which may in turn be attached to channel clamps 420. At this point, wall 110 is generally in place, but each particular clevis may be checked for proper tension. Thereafter, the position of trough 310 may be checked and any further desired adjustment of clevises 330, 470 may be made.

Clamp 420 may be anchored into the bottom of the lower water trough 400, or into the floor or other mounting structure using an anchor bolt 430 to hold it tight. If the water wall assembly 100 does not require the flexing of clamp 420, clevis 470 may attach the lower end 114 of water wall 110 directly to the anchor bolt 430 or may be secured by other means.

Lighting array assembly 200 is now further described with reference to FIGS. 2, 5 and 6. As described above, display 10 may include a lighting assembly 200 that may be positioned behind water wall assembly 100 such that light emitted by lighting assembly 200 passes through and may be manipulated by the water travelling down wall 110 thus creating dramatic visual effects.

The distance between water wall 110 and lighting assembly 200 may vary. For example, this distance may be greater for larger display installations as shown in FIG. 1, but may be smaller for smaller and/or portable displays. The distance between wall and lighting assemblies 100, 200 may also be chosen to enhance or adjust the manner in which the light is focused or altered by the water. That is, this distance may affect the focal points and lengths of the light as discussed later.

Figure 5:
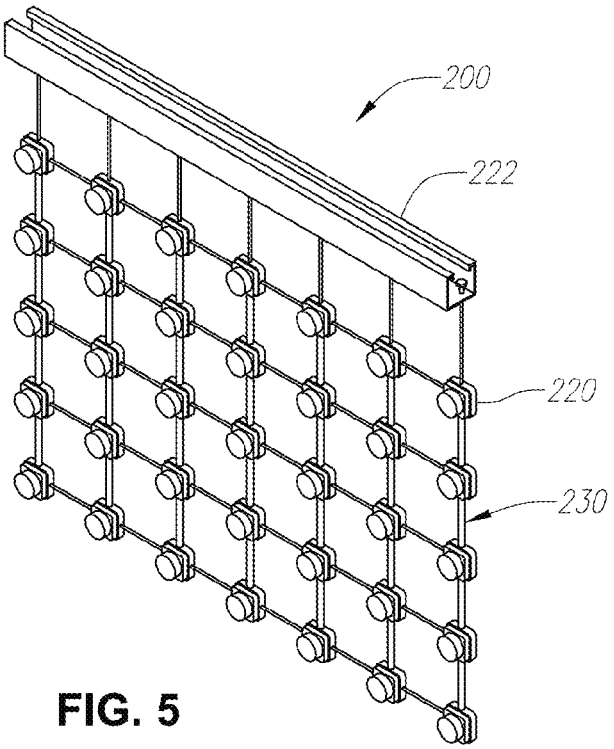
FIG. 5 is a perspective view of a lighting array.

In a preferred embodiment, lighting assembly 200 may include an array of individual LED lights 220, or other types of light sources, that are positioned by a matrix 230 of wires, cables, slats or other structures that may make up a support grid as shown in FIG. 5. When viewed from the front, lights 220 may appear as an array of LED pucks. It should be noted that grid 230 shown in FIG. 5 is provided only for example purposes only, and that many more lights 220 may be used in the horizontal and/or vertical dimensions. The size of the lights 220 may also vary.

The tops of the cables comprising grid 230 may be attached to a member 222, such as a channel. In this manner, grid 230 may generally hang from member 220. Channel 222 may be attached to a wall behind display 10 so that lighting array 230 may be positioned behind water wall 110. Alternatively, channel 222 may be attached to a ceiling or other support structure.

As another alternative, lighting assembly 200 may include a substrate, wall or other mounting surface (not shown) on which lights 220 may be mounted. In this embodiment, the mounting surface may itself be attached to the wall behind display 10 thereby positioning lighting array 230. And in an embodiment where display 10 is intended to be smaller and portable, the mounting surface may comprise the back wall of display 10. For example, in smaller, portable embodiments, all the primary assemblies discussed above may be mounted to an overall frame structure. In this case the mounting surface may be mounted to the back of such a frame structure.

Lighting assembly 200 may be configured in a vertical/horizontal grid as shown in FIG. 5. The spacing of lighting elements 220 within grid 230 may be determined by the particular display effects desired and may range from small spacing to significantly larger spacing. In addition, lighting elements 220 need not be configured in a vertical/horizontal grid but may instead be configured in circular patterns, diagonal patterns or other patterns.

The overall size of lighting assembly 200 may generally correspond to the overall size of water wall assembly 100 but it may also be larger or smaller as desired. As shown in FIG. 6, lighting assembly 200 may be attached to the exterior of a wall for support. To this end, suitable mounting structures 224 involving bolts, clamps, angle irons and/or brackets may be used. In addition, the lighting assembly 200 may be attached to a free-standing support structure, or it may have the ability to support itself without the need for additional support structures.

The electrical current and voltage necessary to power LED pucks 220 such that they emit light may be delivered to each LED puck 220 using wires that travel along the vertical and/or horizontal elements of grid 230. In a preferred embodiment, however, electrical conductivity may be provided by vertical cables. To this end, a number of lights 220 may be daisy-chained along one cable providing conductivity thereto. The electrical wires that deliver the necessary current and voltages to LED pucks 220 may or may not also provide support to the LED pucks 220 within the grid. To this end, additional support cables may be used in addition to the wires providing electrical connections so that the entire weight of grid 230 may be supported.

Each LED puck 220 may include a number of individual LED lights that may represent a variety of fixed colors such as red, green, blue, white or other colors. Alternatively, the LEDs comprising LED puck 220 may have their output color controlled.

Control wires to control the illumination of the LED pucks 220 may travel along the vertical and horizontal elements of grid 230. These control wires may provide control data in real time from a computer or other controller to LED pucks 220 in order to control when certain LED pucks 220 are to illuminate, when certain LED pucks 220 are to stop illuminating, what colors LED pucks 220 are to illuminate, the output wattage of LED pucks 220, and other controllable characteristics of LED pucks 220. These control wires may or may not provide support to the LED pucks 220 within the grid 230.

The control wires may be configured to allow each LED puck 220 to be individually controlled, or the control wires may be configured to allow particular zones or groups of LED pucks 220 to be controlled together in unison. Additionally, the control wires may be configured to control particular vertical or horizontal strands of LED pucks 220 within the grid together in unison. As discussed later, a control room 600 as shown in FIGS. 1A and 1B may house computers, wiring and other components to provide desired lighting and water flow control, as well as control over music or any other type of media that may be included in display 10.

Piping system 500, which may act as a water delivery and return system for display 10, is now further described with reference to FIGS. 4, 7, 8, 9, 10, 11 and 12. In general, piping system 500 may provide the water that travels down water wall 110, catch the water after it has traveled down water wall 110, filter the water, protect against overflow and may also provide a means to drain the water from display 10 or from components thereof.

FIG. 7 is a perspective view of piping system 500 that may be used with the embodiment of display 10 installed to extend up several floors in a building. Certain components of display 10, such as water wall assembly 100 and portions of lower trough assembly 400, have been removed so that an overall view of the various pipes and other components of system 500 may be shown. However, upper trough assembly 300 remains in FIG. 7 to show how it interacts with piping system 500. In general, certain components of piping system 500, such as those components which interact with upper trough assembly 300, are preferably installed after water wall 110 and upper trough 310 have been installed. In this manner, the location of these large assemblies may be established so that the subsequent plumbing may conform thereto.

To provide context, floor 20 has been added to FIG. 7. Floor 20 represents the ground floor 20 shown in FIG. 1 at the base of display 10 and from where individuals may observe. Floor 20 has been added to FIG. 7 to show how certain components of piping system 500 may reside beneath floor 20 and thus remain out of the observer's view, thereby enhancing the visual effects provided by display 10.

Figure 8:
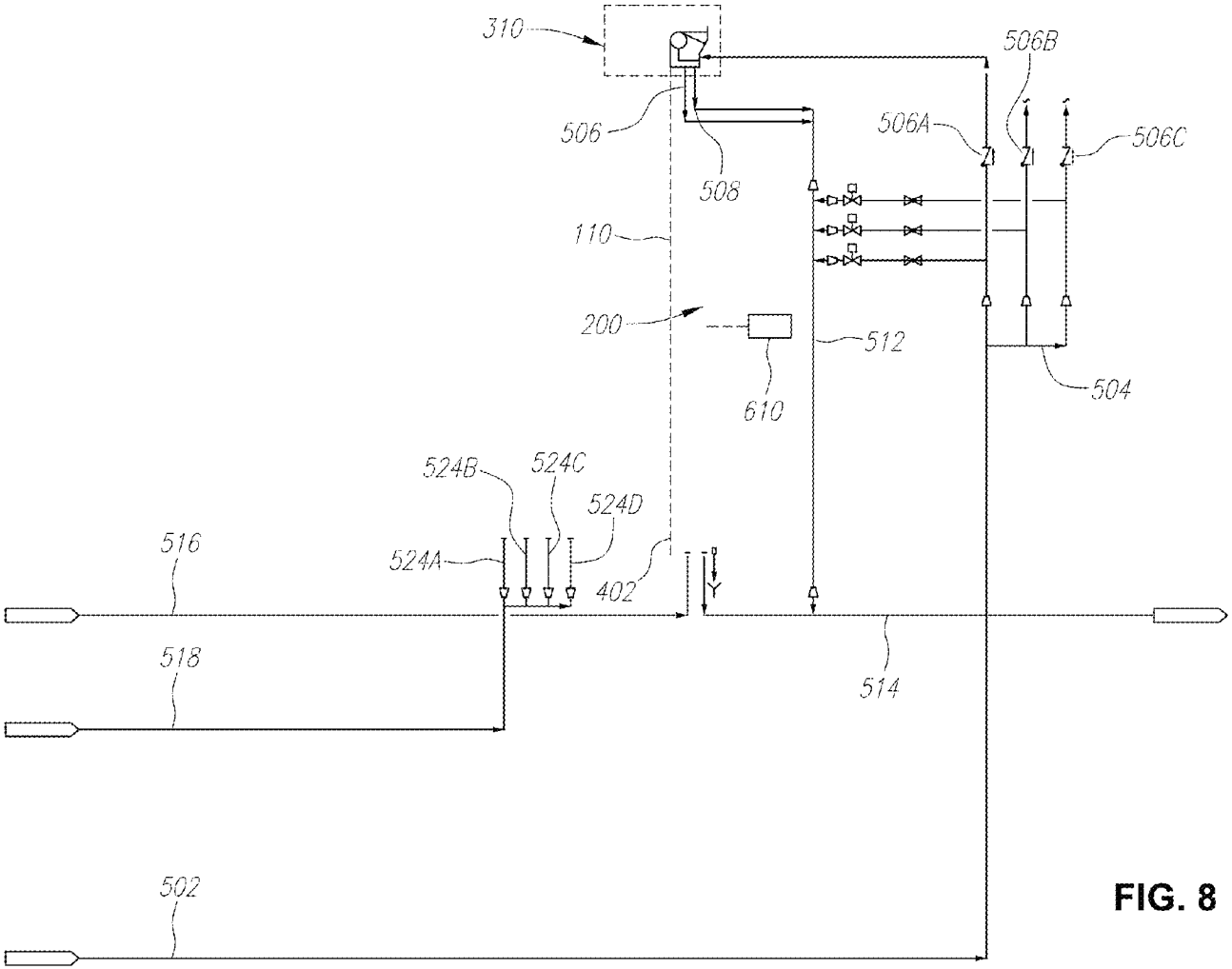
FIG. 8 is a schematic view of a water delivery system and piping thereof.
Figure 10:
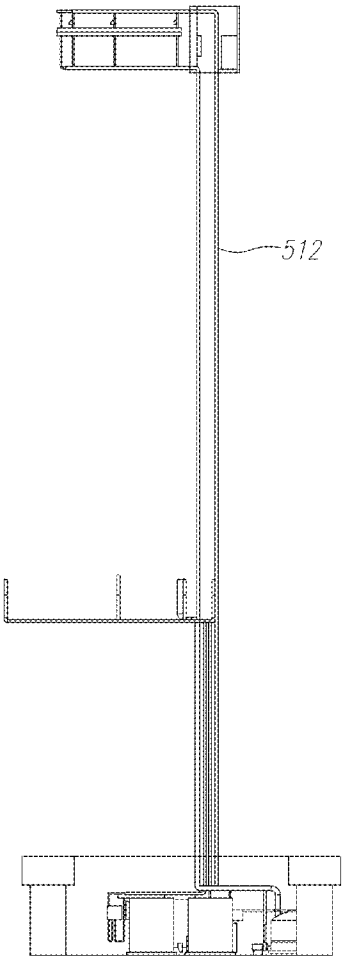
FIG. 10 is a front elevation view of a water delivery system and piping thereof.
Figure 9:
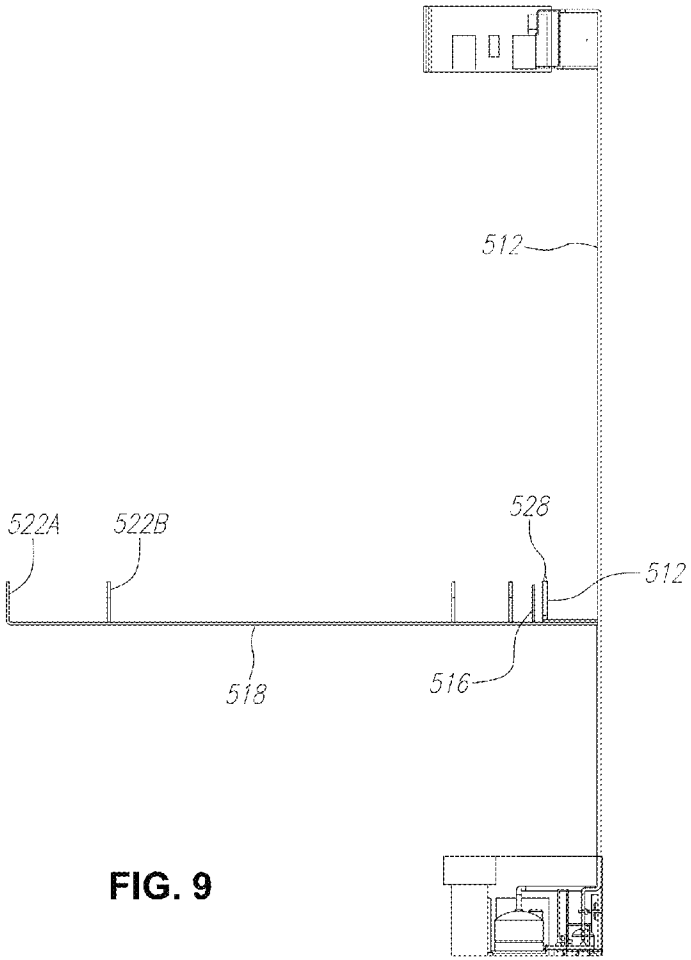
FIG. 9 is a side elevation view of a water delivery system and piping thereof.

As shown in the perspective view of FIG. 7, as well as the schematic of FIG. 8 and the elevation views of FIGS. 9 and 10, water may be pumped up from bottom trough 402 to upper trough 310 through display water supply line 502. Upon extending upward to the vicinity of upper trough 310, line 502 may form display water manifold 504. Separate water lines may then emanate from manifold 504, with each separate line including a valve and then another length of pipe which extends to an inlet 324 to trough 310 as shown in FIG. 4. In FIGS. 7 and 8, these separate lines and valves bear reference numerals 506A, 506B and 506C, respectively.

In a preferred embodiment, lines and valves 506A, 506B, 506C provide the three sources of water for trough 310 as discussed above. As also discussed above, trough 310 may include baffles 350 to address reduce or eliminate any longitudinal wave action caused by the inflow of water from these lines 506A, 506B, 506C and inlets 324. These valves may be referenced as animation valves since they may control the flow of water into trough 310, and thus the flow of water over water wall 110, and ultimately the manner in which the light may be animated or otherwise altered. Valves 506A, 506B, 506C are preferably digital and may be controlled by animation controller 610 which itself may comprise part of the water and video control system 600 that is also shown in FIG. 7. Animation valves 506A, 506B, 506C are shown in more detail in FIG. 12. As shown, each valve may include an inlet, glove valve, solenoid valve and outlet.

Each valve and the water it delivers may correspond to an inlet 124. Alternatively, each valve may deliver water or to an overall feed pipe which delivers water to each inlet. In either scenario, the opening or closing of these valves may change the volume of water delivered to wall 110.

In one embodiment, when the valves are all off, the largest amount of water may flow over bullnose 116 onto wall 110. By opening one valve, the flow from that valve may be bypassed into return lines 508, 512 to lower trough 402 and the flow over bullnose 116 is reduced accordingly. By opening the second valve, flow is further reduced. By opening the third valve, maximum reduction in flow may be set up to bypass adequate flow so that no water flows over bullnose 116.

Trough 310 may also include overflow line 506 and drain line 508 as shown in FIG. 8. These lines 506, 508 may extend to water return manifold 506, which in turn may extend to water drain line 512 that may extend down to lower trough 402. Overflow line 506 may protect against the situation where too much water has been released into trough 310 such that more than the desired amount of water may be flowing down water wall 110 or that water may flow over the sides of trough 310. Drain line 508 may be opened under valve control to drain trough 310 when desired for cleaning, maintenance or other operational reasons.

It is preferred that the above-described water lines are located behind water wall 110, as well as behind lighting array assembly 200 as shown in the elevation view of FIG. 8. This again serves to keep the more industrial aspects of display 10 out of view so that the observer may focus on the visual effects provided thereby.

As indicated above, the water flowing down water wall 110 may be received by lower trough 402, as is any water received by drain line 512. After reaching lower trough 402, this water may then be filtered. To this end, water from lower trough 402 may travel through water return line 514 to a filtration system 520. The filtration may occur through generally known filtration techniques. As shown in FIG. 7, water return line 514 and filtration system 520 may be located below floor 20 to be out of view from the observer.

After filtration, the treated water may travel through treated water supply line 516 to outlets 516A in the bottom of lower trough 402. In this manner, the water in lower trough 402 is generally treated. This is advantageous because the water suctioned from lower trough 402 and pumped up to upper trough 310 for feeding to water wall 110 is thus generally treated.

Piping system 500 may also interact with pool 12 as follows. Another water supply line 518 may extend in front of display 10 along the bottom of pool 12. Line 518 may end in inlets 522A, 522B located in pool 12. Inlets 522A, 522B may feed water along line 518 and through four outlets 524A, 524B, 524C, 524D to lower trough 402. In this manner, the water in pool 12 may also be generally filtered.

Piping system 500 may also include overflow line 528 which preferably avoids bottom trough 402 from overflowing. Drain line 530 may also extend from lower trough 402 in order to drain it when desired.

The manner in which display 10 may operate is now further described. As noted above, light is emitted from lighting array assembly 200 through water wall assembly 100. In this manner, light is emitted from display 10 after it passes through the water cascading down water wall 110, and the appearance of the light may be manipulated by the volume and/or manner in which water flows down to create a dramatic visual display for observers.

As shown in FIG. 4, trough 310 may generally be filled with water as discussed above. Additional water may then be added so that the water level 380 rises above the top surface of bullnose 316 and begins to fall down water wall 112. As noted above, the other sides of trough 310 are higher than the top of bullnose 316 and thus water preferably only exits trough 310 over bullnose 316.

Initially, the water flowing down water wall 110 may generally serve to wet the surface thereof. As more water flows down, water may begin to collect in the spaces 124 of the mesh of wall 110 and water will eventually start flowing down both sides 116, 118 of wall 110 as shown by lines 382, 384 in FIG. 4.

As more water is received by bottom trough 402, its water level may rise as shown by water level line 490 in FIG. 4. If the water level 490 in trough 402 exceeds the height of back wall 460, it may flow over and into overflow line 528 as shown in FIG. 7. In any event, it is preferred that water level 490 not exceed the height of front wall 440. During the course of a performance by display 10, water may be allowed to surge over bullnose 316 and down wall 310. Water flow may also be decreased. In this manner, the appearance and/or edges of the light shining through wall 110 may be softened or hardened.

Figure 13:
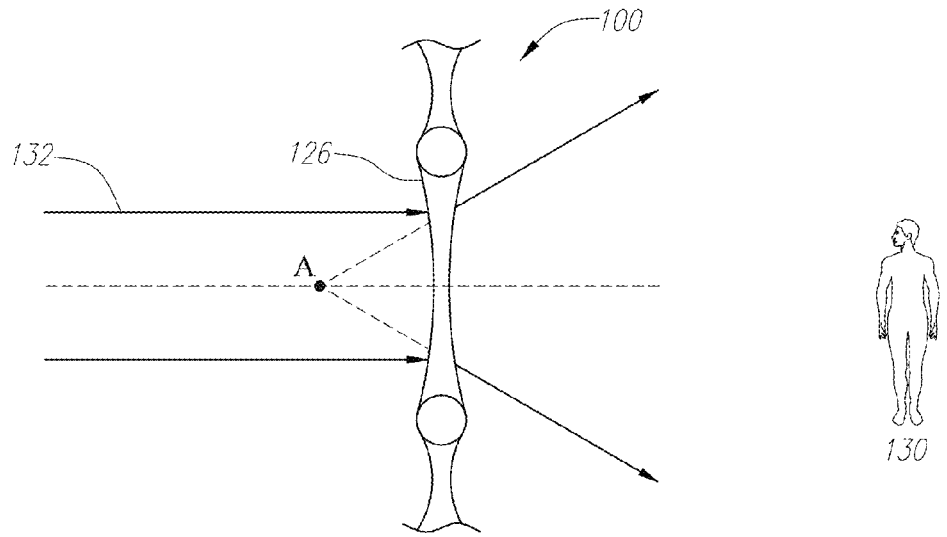
FIG. 13 is a side view of a concave liquid lens.

The manner in which the appearance of the light traveling through water wall 110 may be altered by the flow of water is now further described with reference to FIGS. 1C, 13 and 14. As discussed above, in a preferred embodiment, water wall 110 may comprise a screen or mesh as shown in FIG. 1C which includes a number of horizontally oriented rectangular gaps or spaces 124. As water travels down wall 110, water may collect and become trapped within spaces 124. That is, if enough water is present, the cohesive forces between the water molecules of the water traveling down water wall 110 and/or surface tension that may exist with wall 110 may allow the water to bridge the empty rectangular spaces 124 of the mesh or screen and collect within spaces 124.

When water is trapped within spaces 124, each space 124 may act as a liquid lens that may be used to manipulate the focal point of light emitted by lighting array 200. By manipulating the focal point of the light emitted by lighting array 200, the light may become more focused or sharper in appearance, or may become less focused or softer in appearance.

The type of liquid lens that may result from water being trapped within the rectangular gaps 124 of the water wall 100 may depend on the amount of water that is trapped within the rectangular gap 124 at any point in time. If only enough water is present on water wall 110 such that the water bridges the rectangular gaps 124 but does not bulge out beyond wall 110, the liquid lens that may be formed may generally be a concave liquid lens 126 as shown in FIG. 13.

A beam of light passing through a generally concave lens may be diverged or spread out. Because of this, the beam of light 132 after passing through the concave liquid lens 126 may appear to be emanating from a point A on the axis known as the focal point that may be in front of the concave liquid lens 126, and may appear to a viewer 130 positioned in front of water wall 110 to be focused at a point A behind water wall 110. This is depicted in FIG. 13.

Figure 14:
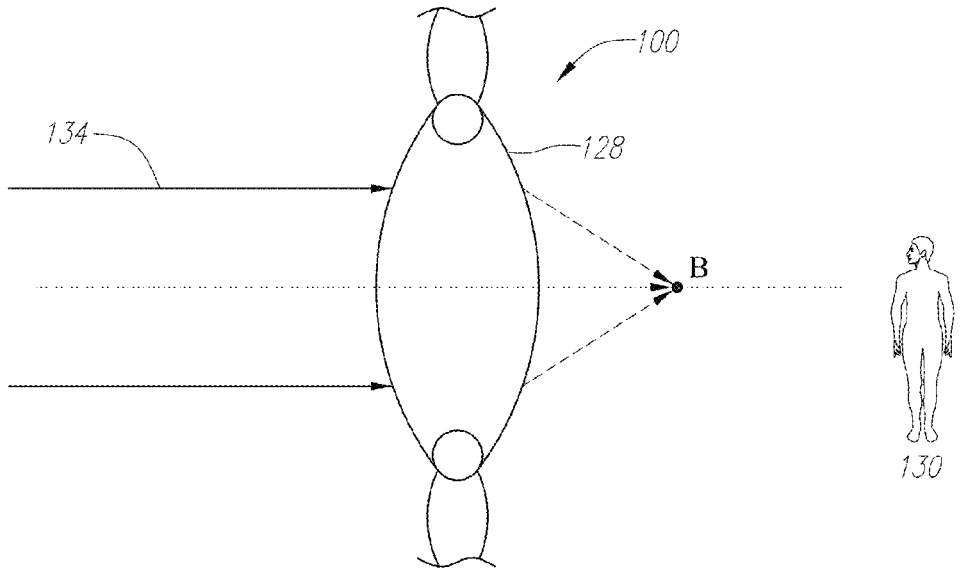
FIG. 14 is a side view of a biconvex liquid lens.
Figure 15:
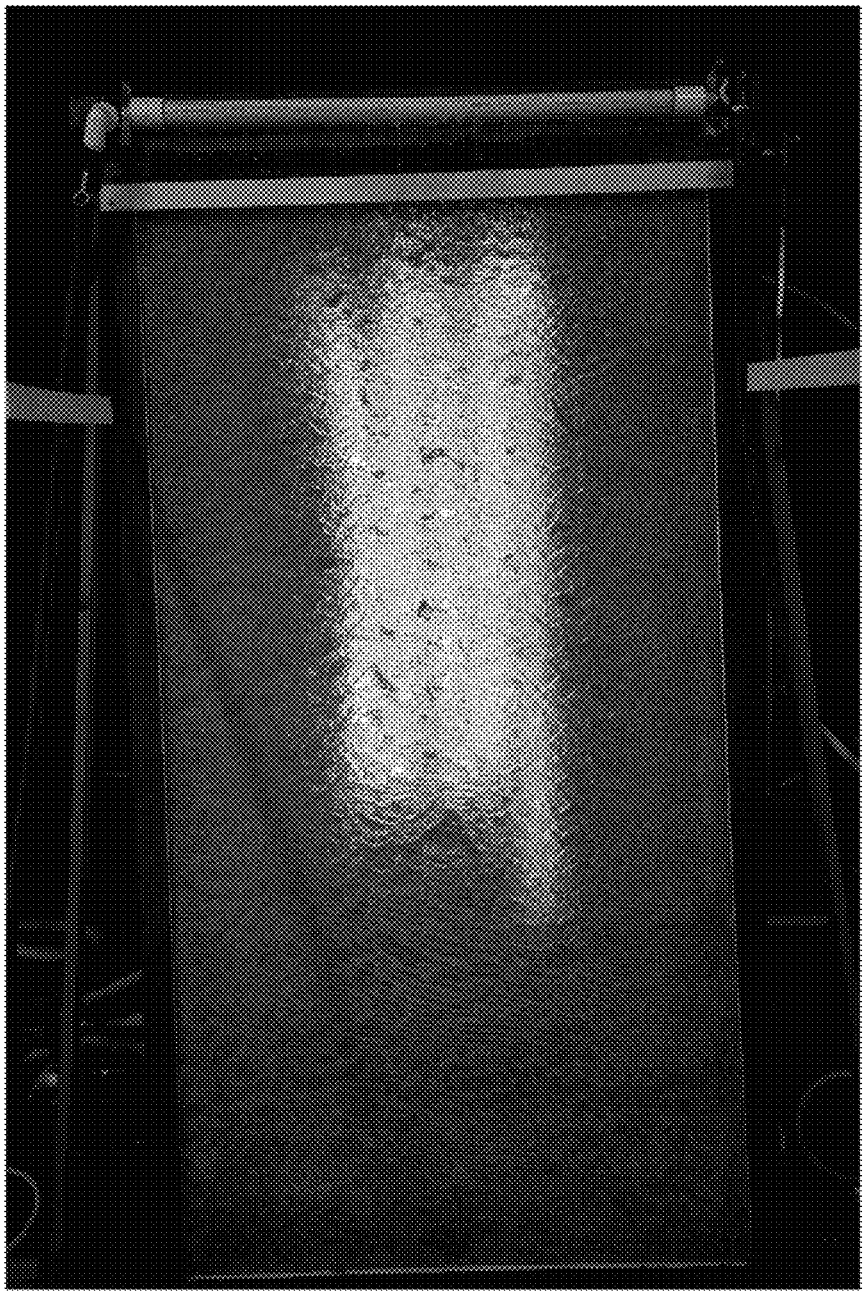
FIGS. 15-21 show examples of the visual effects provided by the display of the current invention.
Figure 16:
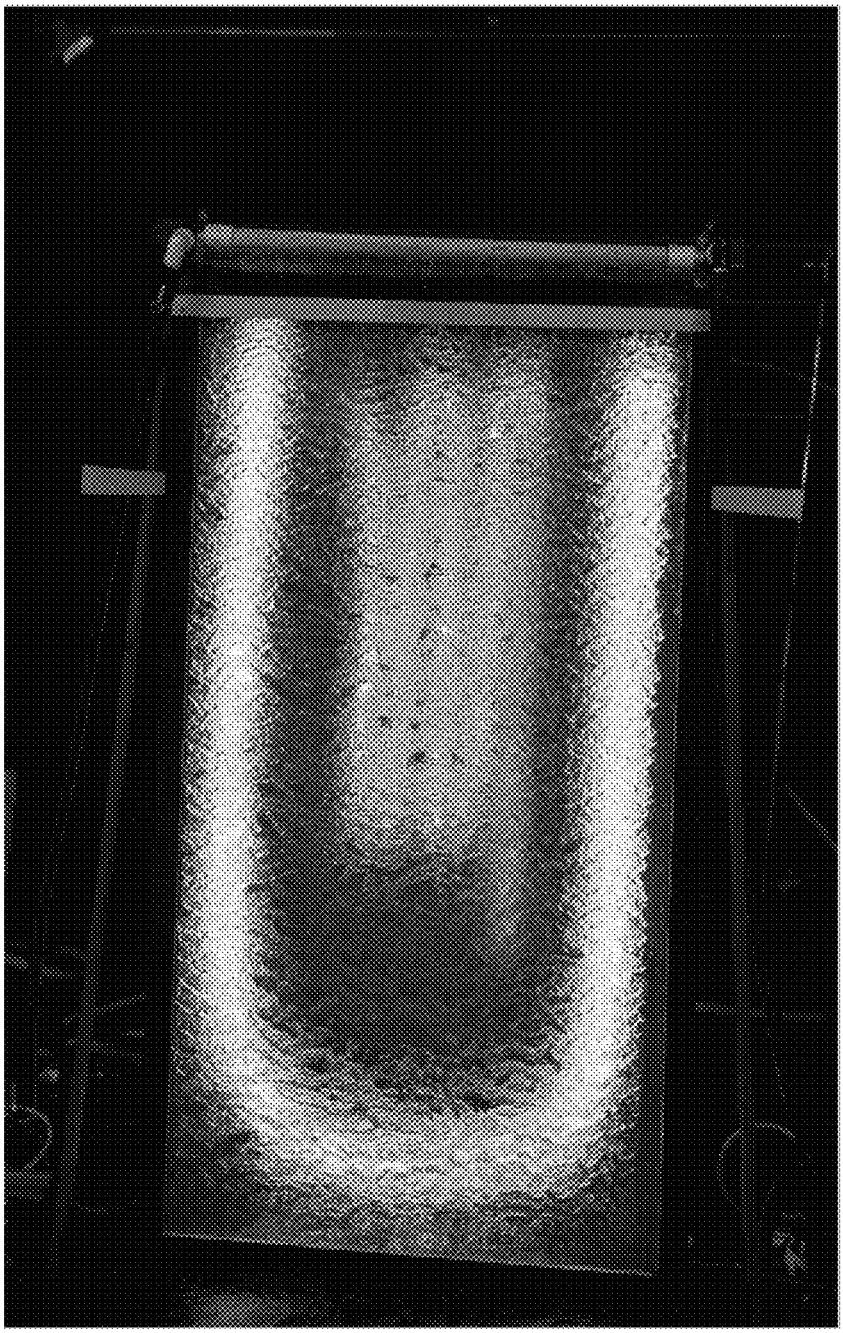
Figure 17:
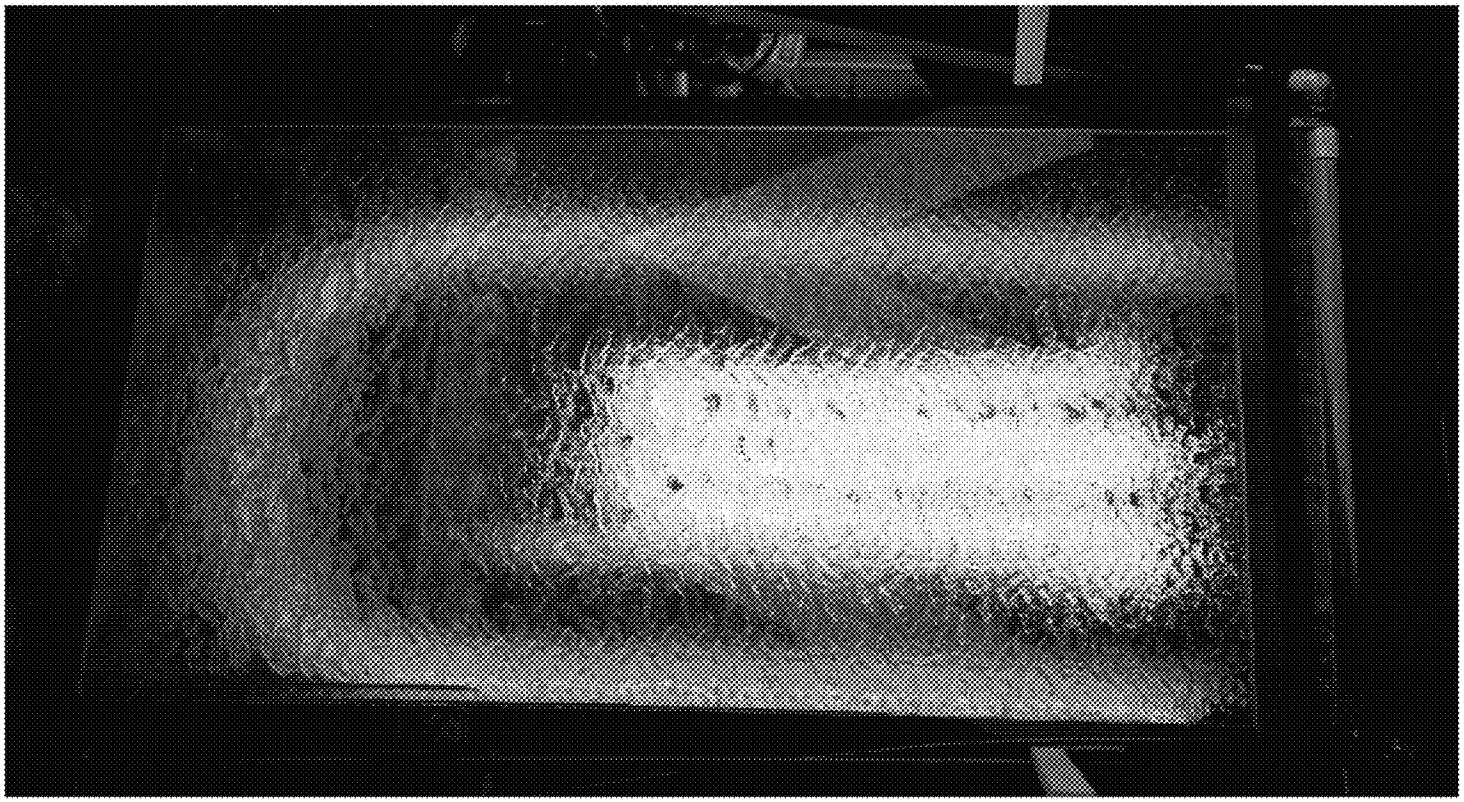
Figure 18:
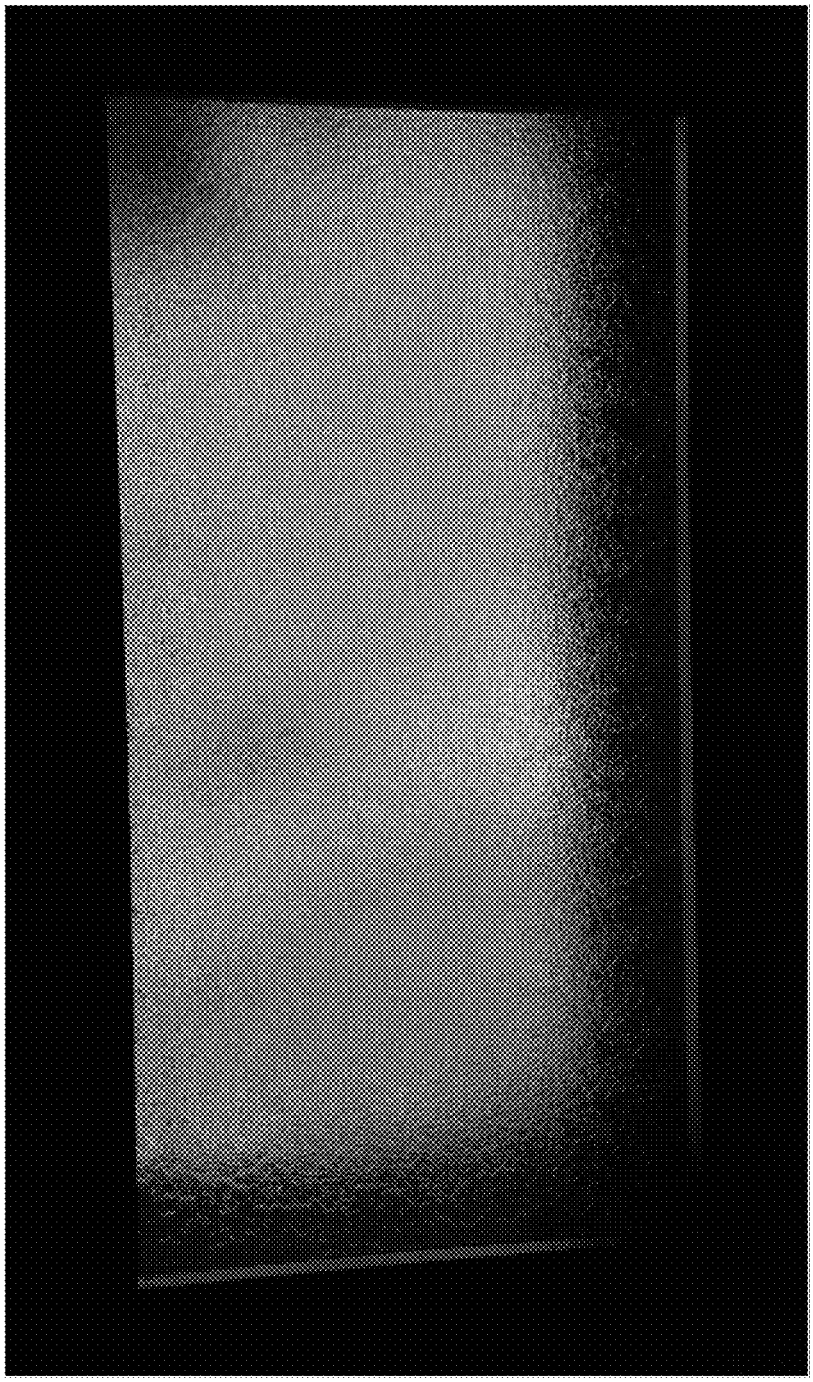
Figure 19:
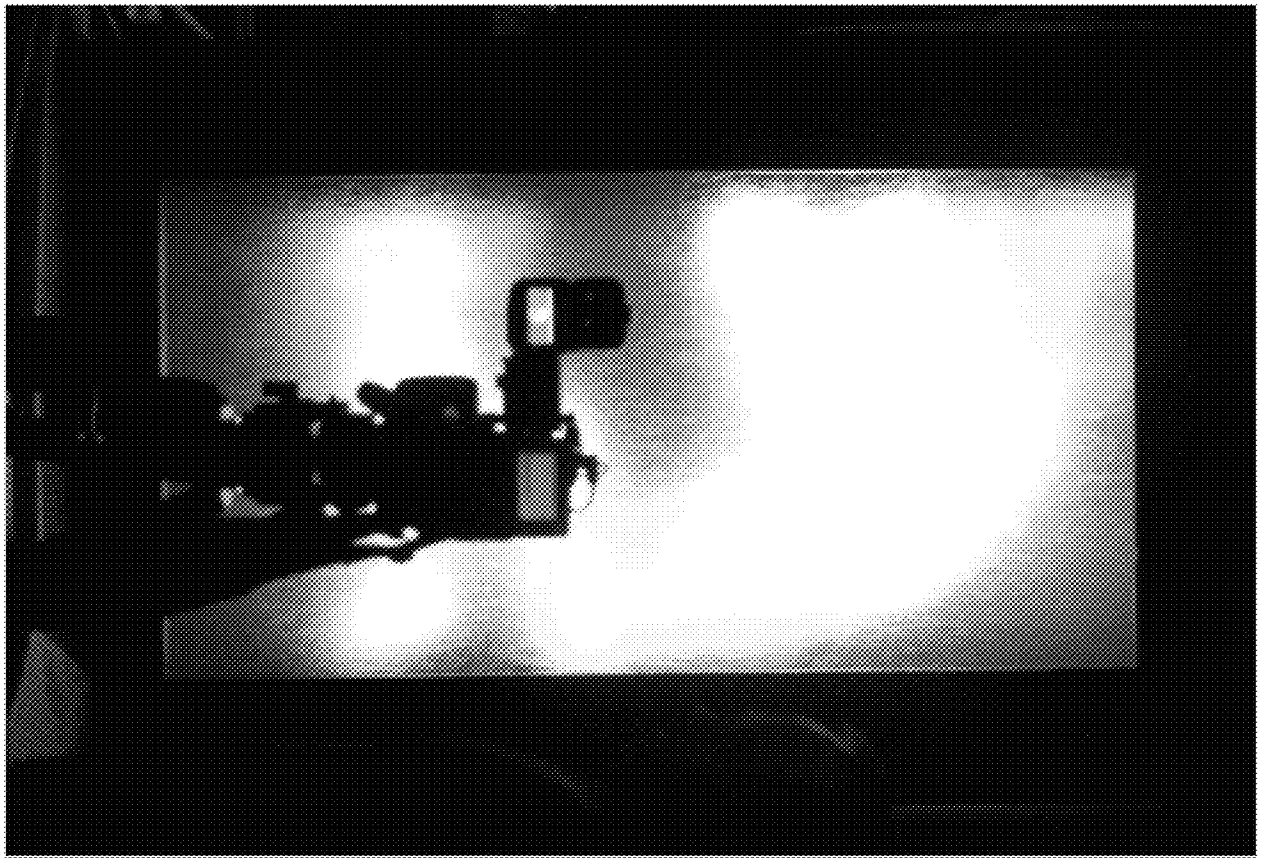
Figure 20:
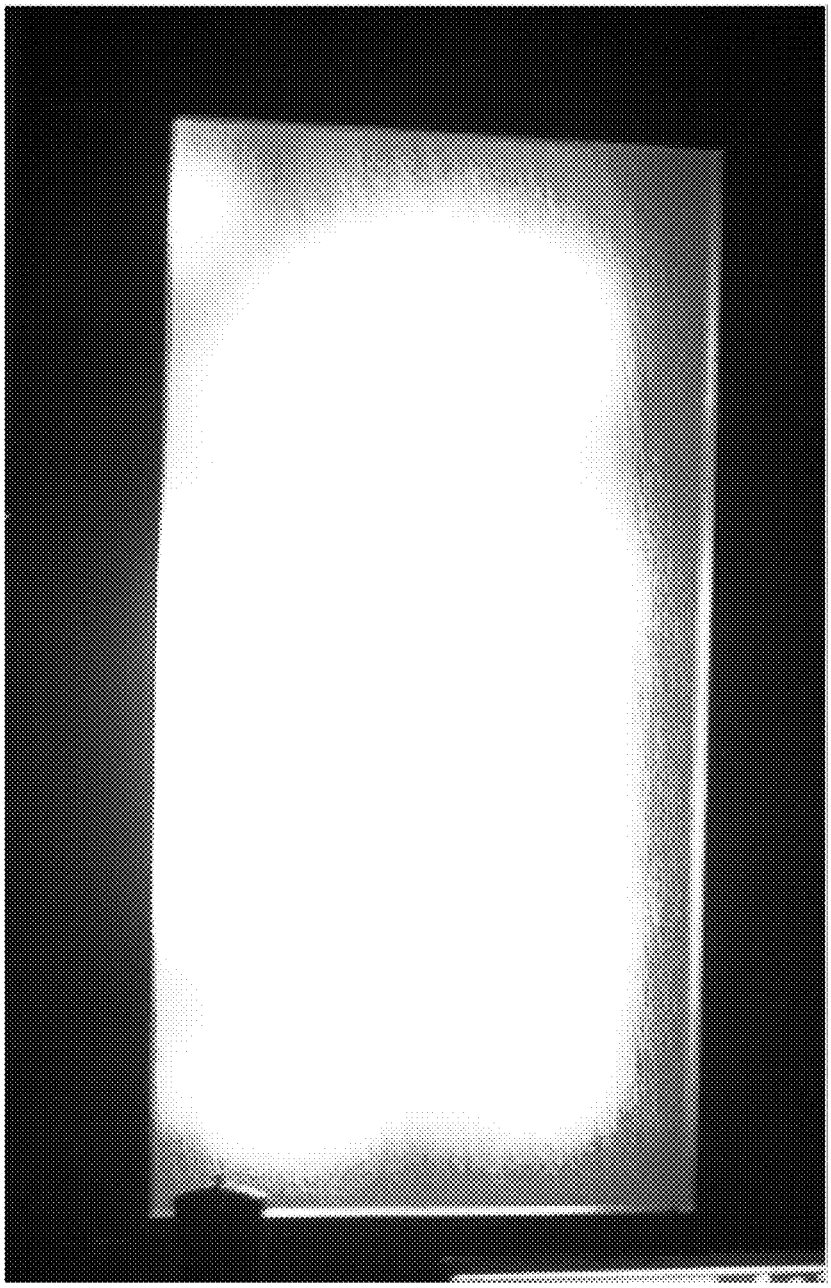
Figure 21:
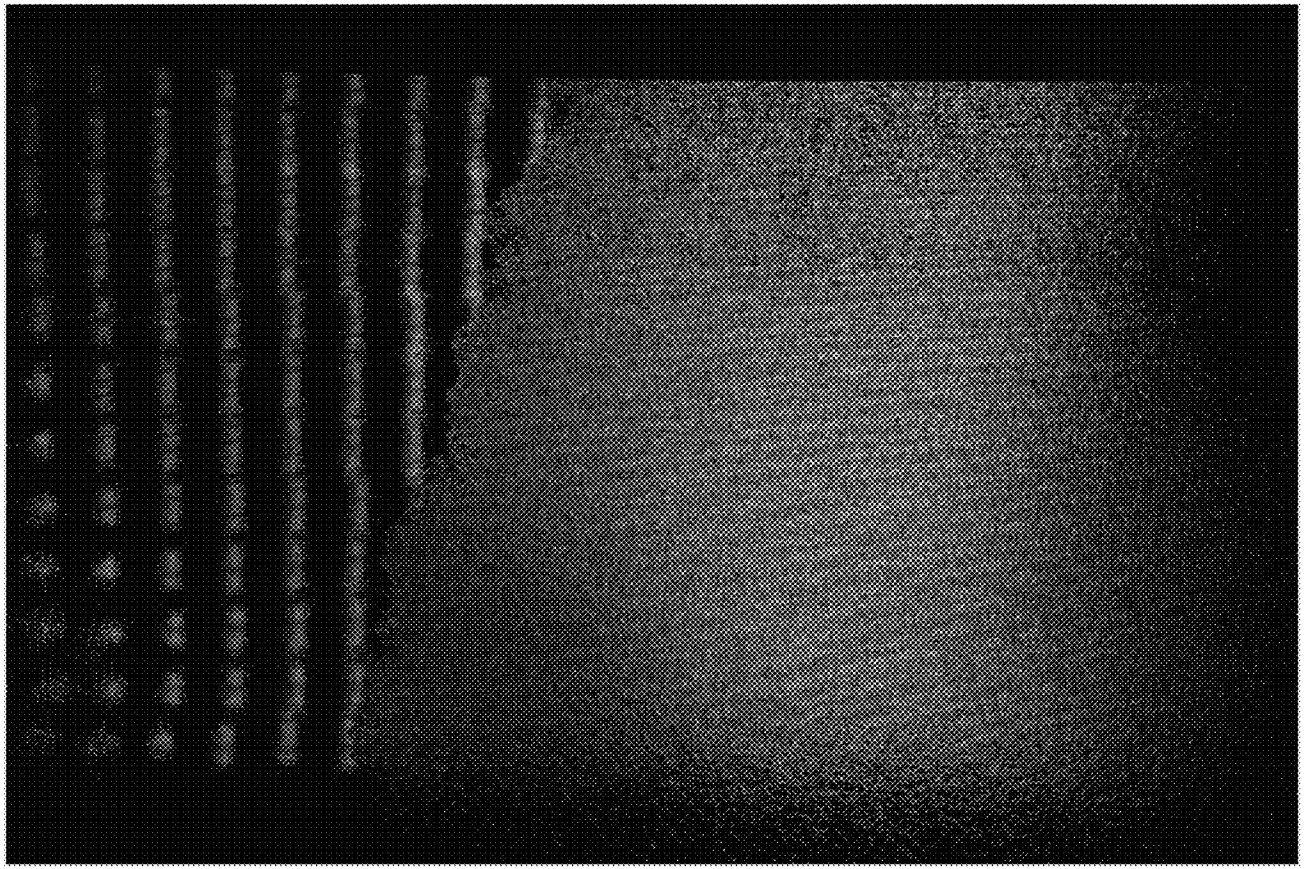
Figure 22:
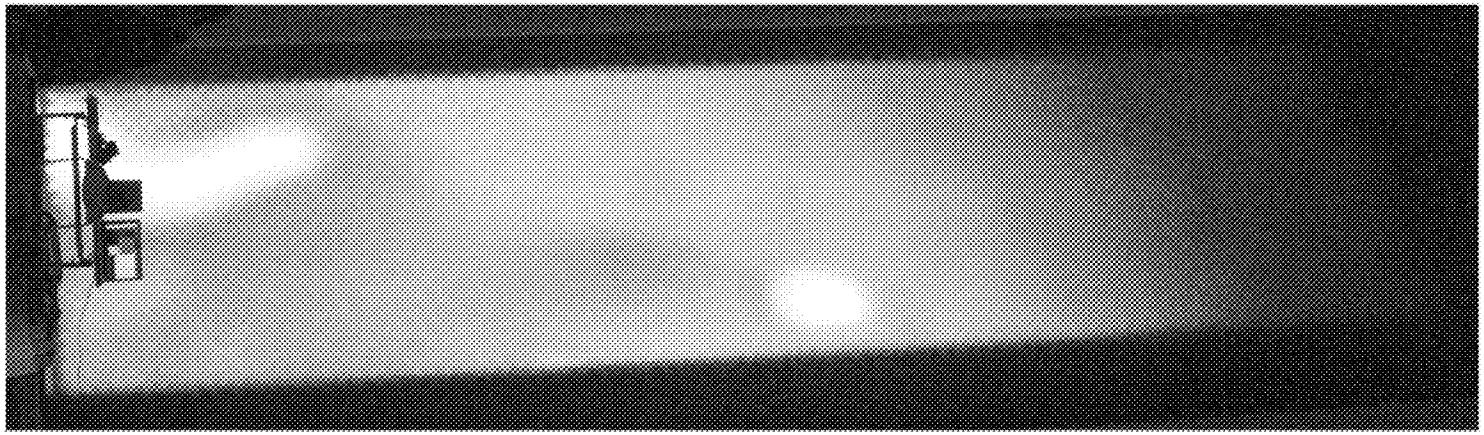
FIGS. 22-28 show examples of the visual effects provided by the display of the current invention.
Figure 23:
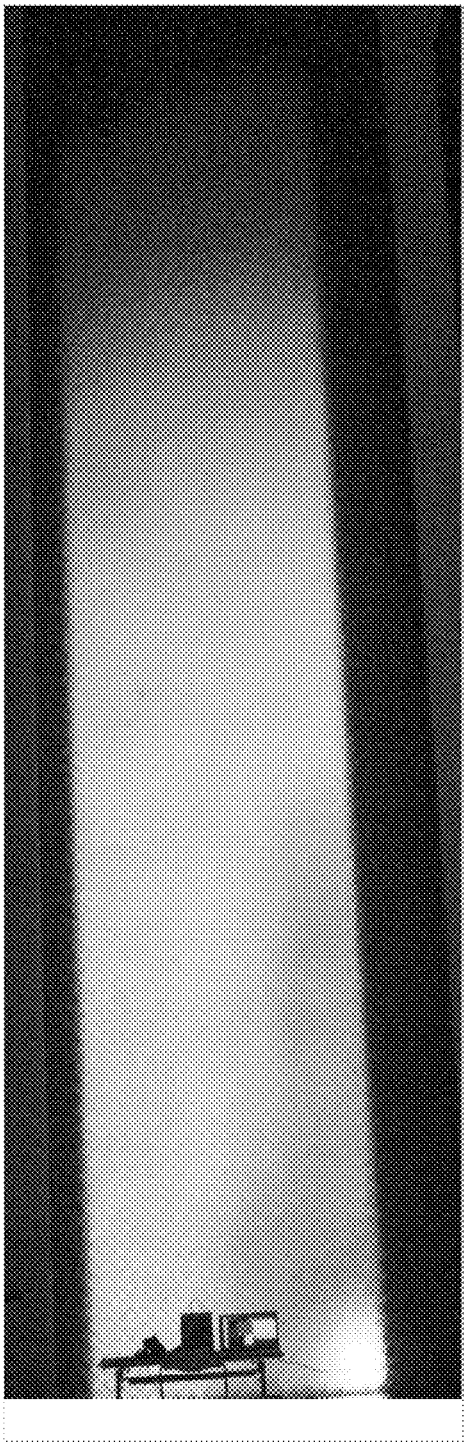
Figure 24:
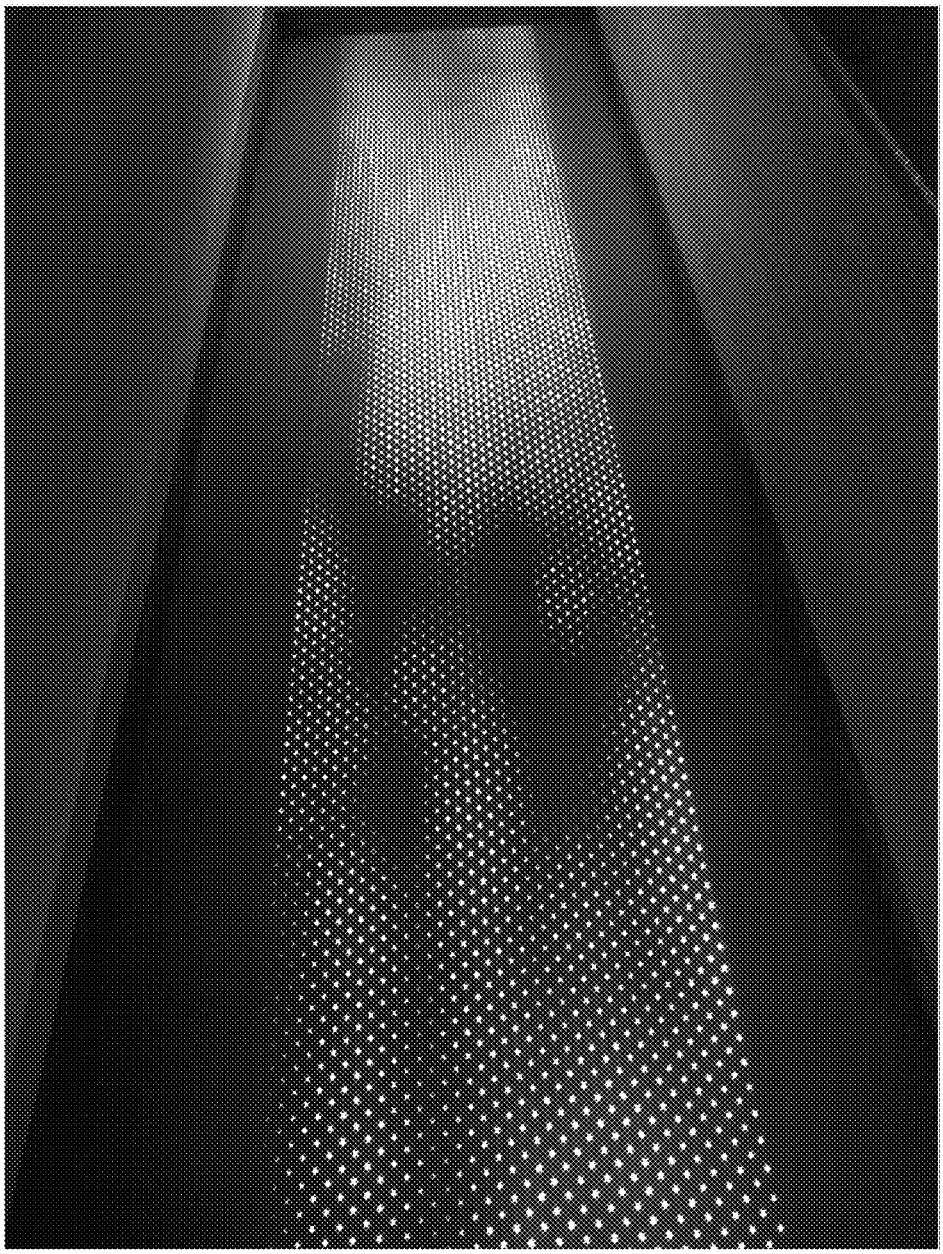
Figure 25:
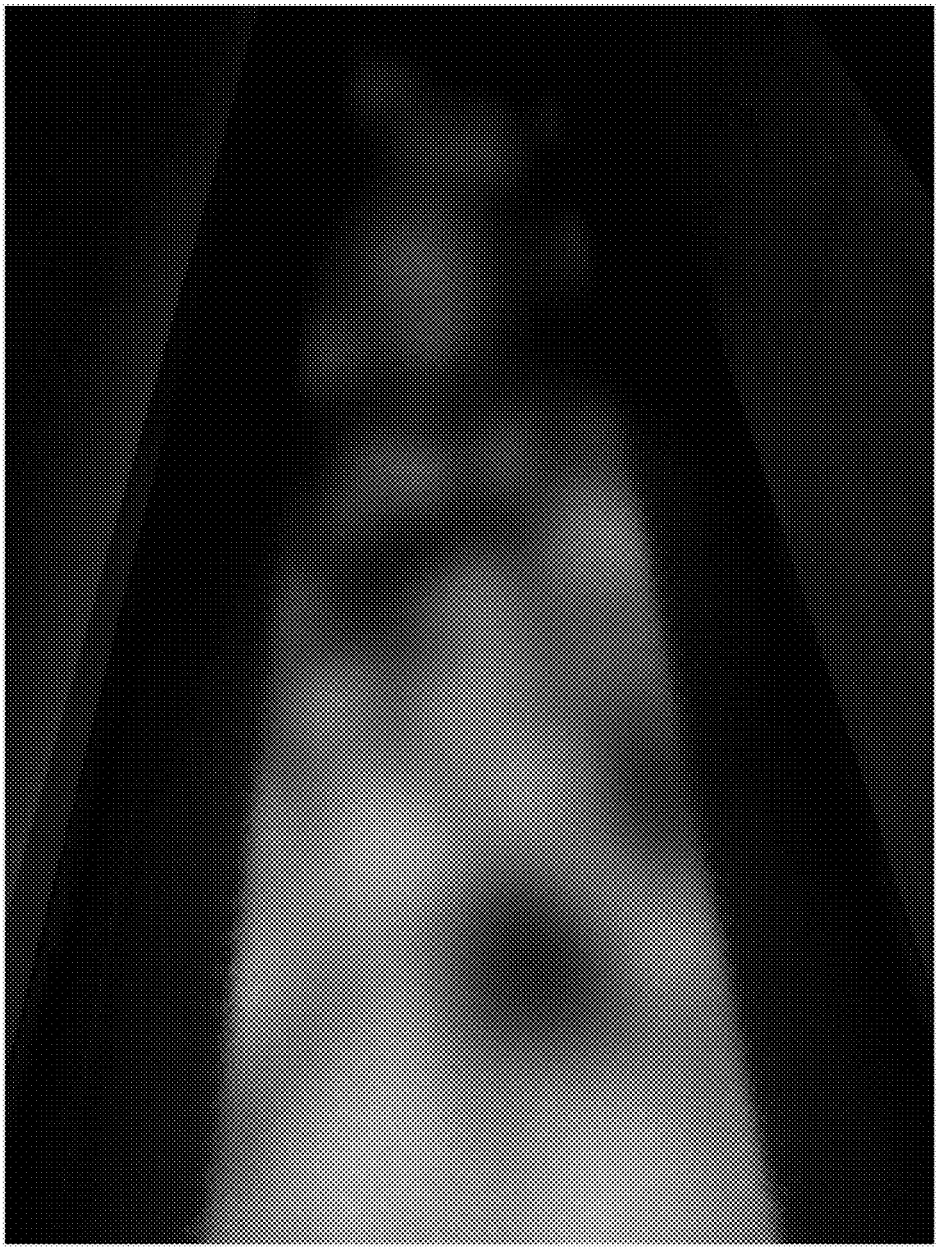
Figure 26:
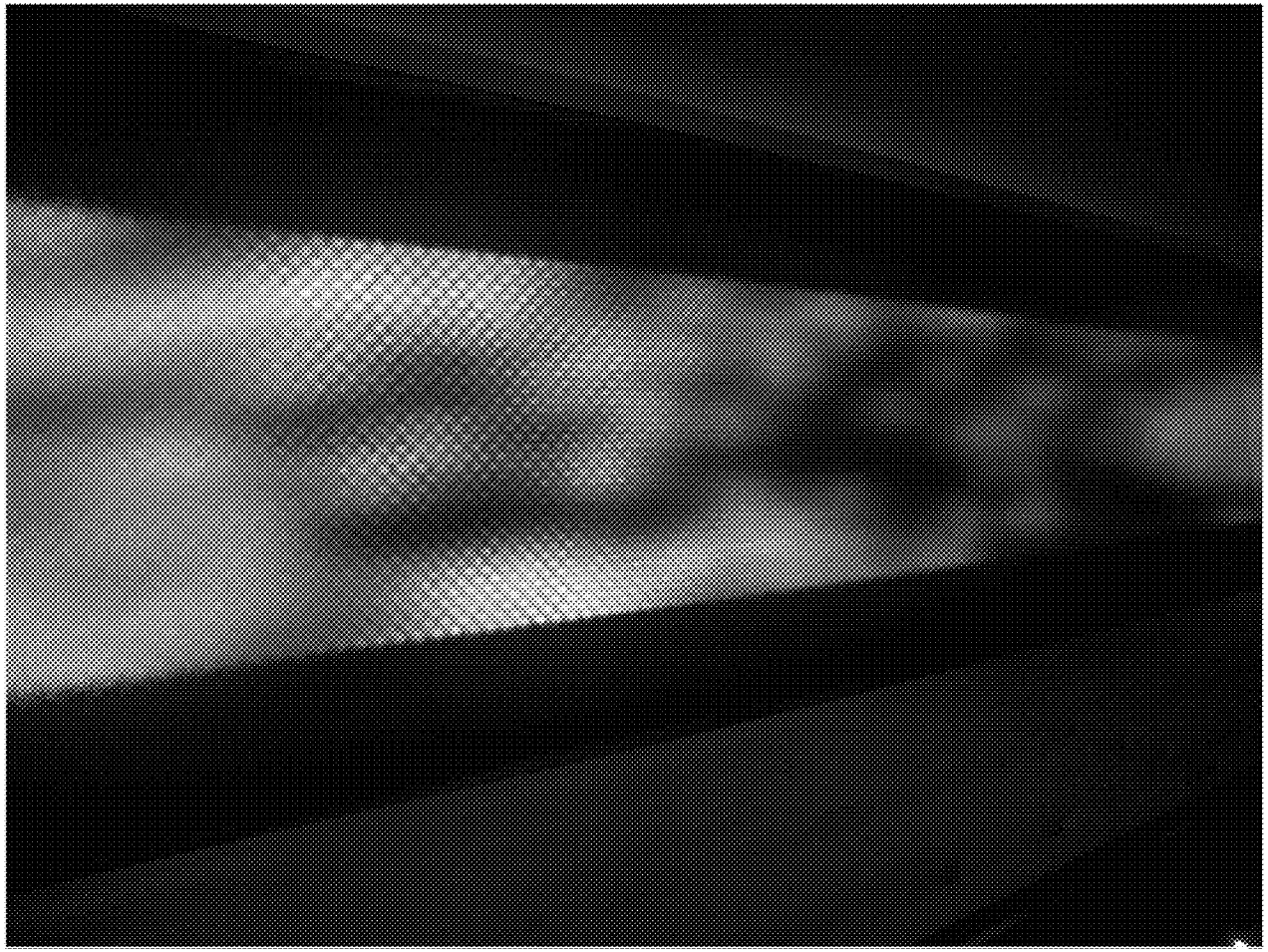
Figure 27:
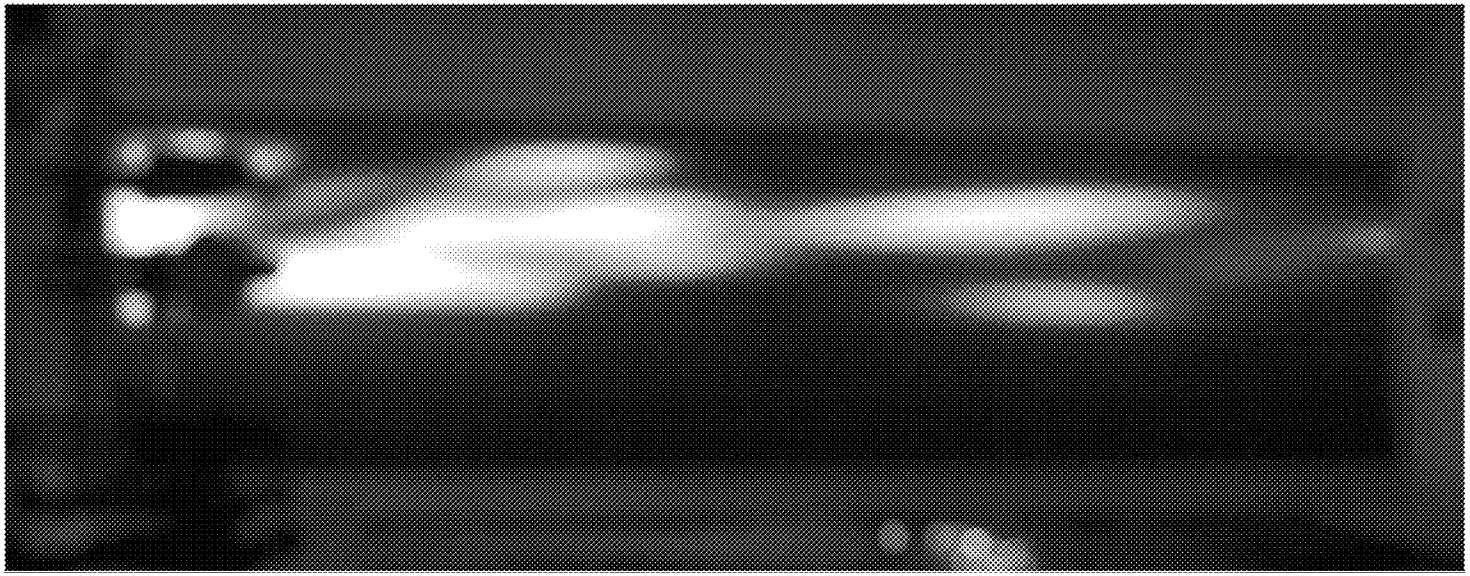
Figure 28:
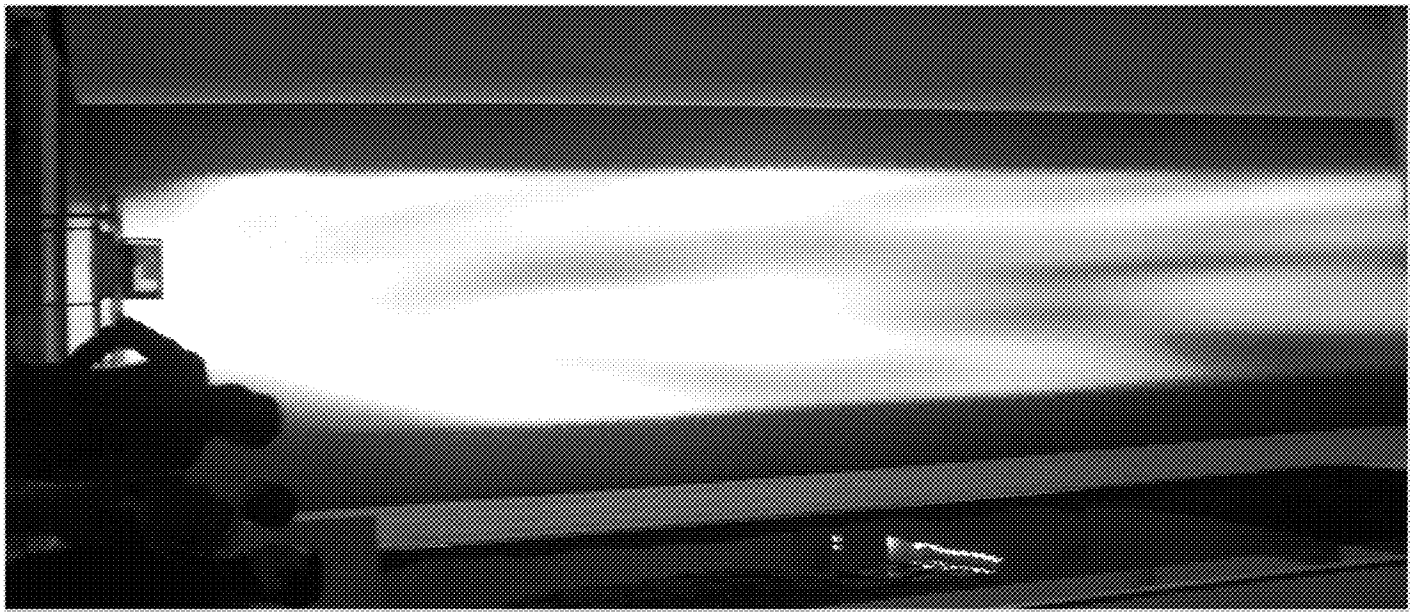

If the flow of water down water wall 100 increases, the meniscus of the water droplets trapped within the spaces 124 may bulge and the liquid lens may become a liquid biconvex lens 128 as shown in FIG. 14. A beam of light travelling through a biconvex lens may be converged. Because of this, the beam of light 134 after passing through the liquid biconvex lens 128 may appear to be emanating from a particular point B on the axis known as the focal point that may be behind the biconvex liquid lens 128, and may appear to a viewer 130 positioned in front of water wall 110 to be focused at a point B in front of water wall 110. This is depicted in FIG. 14.

If even more water flows down water wall 110, the meniscus of the water droplets trapped within spaces gaps 124 may bulge to the point that the surface tension can no longer hold the liquid lens intact due to gravity and the liquid lens may burst and generally become a flat flow of water. This flat flow of water may not have the optical properties of either a concave or biconvex lens, but may instead dampen, blur or otherwise affect the light emitted from the lighting assembly 200 in a non-uniform way.

As stated above, the water flow down water wall 110 may controlled by the water piping assembly 500 which may be controlled in real time by a computer or other controller such as animation controller 610. By controlling the amount of water that may be present at a particular location on water wall 110 at a particular moment in time, the liquid lenses 126, 128 in FIGS. 13 and 14, respectively, that may be present within spaces 124, or the greater flow of water, may be controlled to be concave, biconvex or flat.

By controlling the shape of the liquid lenses 126, 128 or by providing a greater flow, the focal point of the light or its overall appearance emitted by the lighting array 200 passing through water wall 100, may become more focused or sharper appearing to a viewer positioned in front of the display 100, or may become less focused or softer appearing.

By focusing and de-focusing the light emitted by the light source assembly 200 in real time may contribute to the lighting appearing as an abstract form or shape. Furthermore, varying the water flow may vary the edges of the form or shape thereby making the shape or form appear to move. When this is combined with sequentially turning on lights 220 and turning off previously lit lights 220, the shape or form may appear to move across or along display 10.

The focusing and/or alteration of the light may also be affected by the distance between lighting array 200 and wall 110. That is, light emanating from the array 200 may disperse the longer it travels, so the amount of focusing and/or alteration of the light may be varied by the distance the light travels before reaching wall 110. Also, wall 110 may preferably be kept flat so that the amount of focus and/or alteration may be uniform and controlled.

The computer control of display 10 is now further described with reference to FIG. 7. Control room 600 may reside near the top of display 10 as shown in FIG. 1A. It is preferred that control room 600 be located near lighting array 200 to avoid signal degradation that might otherwise occur with longer cables, and to reduce noise and interference.

As described above, to add to the dramatic visual effect of the display 10, the LED pucks 220 may be controlled in real time to switch on and off, and to change color and output wattage. Software may reside in the computer or controller of the lighting assembly 200 and the water piping assembly 500 such that both the lighting assembly 200 and the water piping assembly 500 may be controlled in real time in an orchestrated fashion. That is, the amount of water present on water wall 110 at any given moment may be controlled to manipulate the light passing through water wall 110 as described above, and at the same time, lighting assembly 200 may also be controlled to turn on/off and to change color and output power. By controlling both the focal point manipulation of the light passing through water wall 110 and lighting assembly 200 together in real time in an orchestrated fashion, the result may be a dramatic flowing color show of changing abstract forms. These forms may be made to appear moving and may provide the effect of moving art.

In addition, software residing within the controller of the water piping assembly and the lighting assembly may have preprogrammed shows that are automated. Conversely, the software may allow for the manual orchestration of the display 10. In addition, the software may allow for a combination of automated preprogrammed shows that may be manually altered and otherwise manually controlled in real time as desired.

Software may be written to control the flow of water and lighting, as well as music, other audio or other media to incorporate into the performance of display 10. A number of such different programs may be loaded to display 10 and may be performed as desired.

As noted above, display 10 is preferably controlled to provide visual effects, such as a moving light painting, with variations in the clarity of the pixels programmed with water flow. Examples of various types of visual effects that may be provided are shown in FIGS. 1 and 15-28. As shown, various colors, patterns, shapes and movement may be provided. FIGS. 15-21 show display 10 in a smaller version that may be portable. FIGS. 22-28 show the larger version that generally corresponds to that shown in FIG. 1. As shown, colors may merge from one to another, shapes may transform from one to another, and shapes may move across display 10. These may generally provide the appearance of moving art.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A display, comprising:

a lighting array including a plurality of light sources;

a wall that comprises a solid material having an area that is aligned with at least a portion of the lighting array, wherein the transparency of the wall varies over the area, and wherein the wall is positioned so that light from the lighting array travels through at least portions of the wall; and water flowing down the wall;

wherein the appearance of the light is altered by the water flow.

2. The display of claim 1, wherein the volume of water flow is increased or decreased thereby altering the appearance of the light traveling through the wall.

3. The display of claim 2, wherein the lighting array includes a plurality of light sources that are turned on and off, that are dimmed or brightened and/or that change color.

4. The display of claim 3, further comprising a computer that controls the water flow and lights.

5. The display of claim 1, wherein the light appears as moving art.

6. The display of claim 1, wherein at least regions of the wall are substantially opaque.

7. The display of claim 1 wherein the wall has a textured surface that collects at least some of the water as it flows down the wall thereby altering the appearance of the light.

8. A water and light display, comprising:

a wall that includes a plurality of open portions and opaque portions and that is configured to allow light to travel therethrough;

a water delivery system located to deliver water to the wall; and a lighting array located behind the wall;

wherein water is delivered to the wall and travels down the wall while light from the lighting array travels through the wall and the water; and wherein the wall comprises a plurality of horizontal rods held by a plurality of vertical cables or wires thereby forming the plurality of open portions through which the light travels.

9. The water and light display of claim 8, further comprising a water return system that is located to receive the water traveling down the wall and that is configured to return at least some of the received water to the water delivery system.

10. The water and light display of claim 9, wherein the water delivery system includes a trough that is located to deliver water at or near a top of the wall.

11. The water and light display of claim 10, further comprising at least one pump to transfer water from the water return system to the trough.

12. The water and light display of claim 10, wherein the trough includes at least one baffle to reduce longitudinal movement of water in the trough.

13. The water and light display of claim 8, wherein the lighting array includes a plurality of LEDs.

14. The water and light display of claim 13, wherein the plurality of LEDs are positioned by a support grid.

15. The water and light display of claim 8, wherein the plurality of horizontal rods and vertical cables form a mesh.

16. A water and light display, comprising:

a wall that includes a plurality of open portions and opaque portions and that is configured to allow light to travel therethrough;

a water delivery system located to deliver water to the wall; and a lighting array located behind the wall;

wherein water is delivered to the wall and travels down the wall while light from the lighting array travels through the wall and the water; and wherein the plurality of open portions are configured to collect water traveling down the wall.

17. The water and light display of claim 16, wherein the water collected by at least some of the plurality of open portions acts as a liquid lens to manipulate the appearance of the light traveling through the wall.

18. The water and light display of claim 17, wherein the liquid lens is formed as a concave liquid lens or a convex liquid lens to vary the focal point of the light emitted from the lighting array to manipulate the appearance of the light traveling through the wall.

19. The water and light display of claim 17, wherein the appearance of the light traveling through the wall is manipulated by varying the amount of water flowing down the wall.

20. The water and light display of claim 18, wherein the appearance of the light is manipulated to be softer when the liquid lens is formed as a concave liquid lens and to be sharper when the liquid lens is formed as a convex liquid lens.

* * * * *